US012029299B2

(12) United States Patent
Zhu et al.

(10) Patent No.: US 12,029,299 B2
(45) Date of Patent: Jul. 9, 2024

(54) INTELLIGENT HAIR DRYER, JOB CONTROL AND INFORMATION DISPLAY METHODS THEREOF, AND STORAGE MEDIUM

(71) Applicant: TINECO INTELLIGENT TECHNOLOGY CO., LTD., Suzhou (CN)

(72) Inventors: Tao Zhu, Suzhou (CN); Xisheng Xu, Suzhou (CN)

(73) Assignee: TINECO INTELLIGENT TECHNOLOGY CO., LTD., Suzhou (CN)

( * ) Notice: Subject to any disclaimer, the term of this patent is extended or adjusted under 35 U.S.C. 154(b) by 259 days.

(21) Appl. No.: 17/417,722

(22) PCT Filed: Dec. 27, 2019

(86) PCT No.: PCT/CN2019/129392

§ 371 (c)(1),
(2) Date: Jun. 23, 2021

(87) PCT Pub. No.: WO2020/125807

PCT Pub. Date: Jun. 25, 2020

(65) Prior Publication Data

US 2022/0071367 A1 Mar. 10, 2022

(30) Foreign Application Priority Data

Dec. 20, 2018 (CN) ..... 201811563745.3
Sep. 19, 2019 (CN) ..... 201910887334.8

(51) Int. Cl.
*A45D 20/12* (2006.01)

(52) U.S. Cl.
CPC ..... *A45D 20/12* (2013.01); *A45D 2020/128* (2013.01)

(58) Field of Classification Search
CPC ... A45D 20/12; A45D 20/10; A45D 2020/128
(Continued)

(56) References Cited

U.S. PATENT DOCUMENTS 4,260,875 A * 4/1981 Walter ..... A45D 20/12 34/554
2013/0156942 A1* 6/2013 Yamakaji ..... H01M 4/625 427/126.6

(Continued)

FOREIGN PATENT DOCUMENTS

CN 103251196 A 8/2013
CN 204796994 U * 11/2015

(Continued)

OTHER PUBLICATIONS

The World Intellectual Property Organization (WIPO) International Search Report With Translation and Written Opinion for PCT/CN2019/129392 dated Mar. 26, 2020 11 pages.

*Primary Examiner* — John P McCormack

(57) ABSTRACT

The present disclosure provides an intelligent hair dryer, including: an airflow detection channel, a sensor, a control system, and a main air duct. The airflow detection channel is arranged on at least one side of the main air duct, and an air inlet of the airflow detection channel opens towards a blowing direction of the main air duct of the intelligent hair dryer. The sensor is arranged in the airflow detection channel, and is configured to detect state information of airflow having touched a blown object. The control system may control operation state of the intelligent hair dryer by using the state information of the airflow. By using the intelligent hair dryer of the present disclosure, it can ensure that a user is saved from the trouble of repeatedly adjusting the gear position of the hair dryer during use.

3 Claims, 5 Drawing Sheets

(58) Field of Classification Search
USPC ..... 34/96, 283
See application file for complete search history.

(56) References Cited

U.S. PATENT DOCUMENTS

| | | | | |
|---|---|---|---|---|
| 2016/0316883 | A1* | 11/2016 | Guerra | A45D 6/20 |
| 2017/0055667 | A1* | 3/2017 | Chen | A45D 20/12 |
| 2018/0027940 | A1* | 2/2018 | Goldman | H01M 50/213 |
| 2019/0098978 | A1* | 4/2019 | Thiebaut | A45D 20/12 |
| 2019/0125055 | A1* | 5/2019 | Yue | G01J 5/04 |
| 2021/0330052 | A1* | 10/2021 | Lelieveld | A45D 20/10 |

FOREIGN PATENT DOCUMENTS

| | | | | | |
|---|---|---|---|---|---|
| CN | 204796994 | U | | 11/2015 | |
| CN | 205456832 | U | * | 8/2016 | |
| CN | 205456832 | U | | 8/2016 | |
| CN | 205568164 | U | | 9/2016 | |
| CN | 107495597 | A | * | 12/2017 | |
| JP | 2017196019 | A | | 11/2017 | |
| KR | 1625834 | B1 | * | 5/2016 | A45D 20/10 |

* cited by examiner

INTELLIGENT HAIR DRYER, JOB CONTROL AND INFORMATION DISPLAY METHODS THEREOF, AND STORAGE MEDIUM

CROSS-REFERENCE

This application is a national phase entry under 35 U.S.C § 371 of International Application No. PCT/CN2019/129392, filed on Dec. 27, 2019, which claims priority to Chinese Patent Application No. 201811563745.3, filed on Dec. 30, 2018, with the title "INTELLIGENT HAIR DRYER AND METHOD FOR AUTOMATICALLY CONTROLLING OPERATION OF INTELLIGENT HAIR DRYER", and Chinese Patent Application No. 201910887334.8, filed on Sep. 19, 2019, with the title "INTELLIGENT HAIR DRYER AND METHOD FOR AUTOMATICALLY CONTROLLING OPERATION OF INTELLIGENT HAIR DRYER", the entire contents of which are incorporated herein by reference.

TECHNICAL FIELD

The present disclosure relates to the field of a hair dryer, and more particularly, to an intelligent hair dryer, job control and information display methods thereof, and a storage medium.

BACKGROUND

A hair dryer is widely used in daily life, and is mainly used for drying and shaping hair, and may also be used for local drying, heating and physiotherapy in laboratories, physiotherapy rooms and industrial production, art work, and the like. The operation principle of the hair dryer is described as below. A rotor is directly driven by a motor to drive a fan blade to rotate, and when the fan blade rotates, air is sucked from an air inlet, and a centrifugal airflow formed hereby is blown out from a front nozzle of the hair dryer. When the air passes through, hot air is blown out if a heating wire installed on a heating bracket in the nozzle has been powered on and heated up; and cold air is blown out if a selector switch does not make the heating wire power on and heat up. The hair dryer implements drying and shaping based on this operation principle.

When using a current hair dryer, a user selects heat and air volume gear positions by herself. When the hair is dried, a large amount of air is required to rapidly blow away moisture if the hair is very wet. That is, the hair is dried at about sixty percent by hot air, and then is dried at about eighty percent by cold air, and subsequently is waited to be naturally dried. In the entire process of using the hair dryer, the user needs to adjust the air volume and the heat for multiple times, which obviously increases the trouble of repeatedly adjusting the gear position by the user, and thus results in poor user experience.

In another aspect, during using the hair dryer, the user cannot accurately perceive the current state of a blown object of the hair dryer, and can only roughly perceive the current state of the blown object of the hair dryer, which results in poor user experience.

SUMMARY

The present disclosure provides an intelligent hair dryer and a job control method thereof, to solve the problem that the user needs to repeatedly adjust the gear position in the actual process of using the existing hair dryer, and meanwhile also to enhance the user experience.

The present disclosure provides an intelligent hair dryer, which includes an airflow detection channel, a sensor, a control system, and a main air duct.

The airflow detection channel is arranged on at least one side of the main air duct, and an air inlet of the airflow detection channel opens towards a blowing direction of the main air duct of the intelligent hair dryer to collect airflow having touched a blown object.

The sensor is arranged in the airflow detection channel, and is configured to detect state information of the airflow having touched the blown object.

The control system is configured to receive the state information of the airflow and control operation state of the intelligent hair dryer by using the state information of the airflow.

Optionally, when the control system controls the operation state of the intelligent hair dryer by using the state information of the airflow, the control system is specifically configured to:

obtain blowing parameters of the intelligent hair dryer required by the blown object according to the state information of the airflow; and control a rotation speed of a fan unit and/or a heating temperature of a heating unit in the main air duct to adjust the blowing parameters of the intelligent hair dryer to blowing parameters of the intelligent hair dryer required by the blown object.

Optionally, the state information of the airflow includes at least one of temperature information and humidity information of the airflow.

Optionally, the airflow detection channel is connected to an upstream region of the fan unit, and an air outlet of the main air duct is located in a downstream region of the fan unit.

Optionally, an area of the air outlet of the main air duct is larger than an area of the air inlet of the airflow detection channel.

Optionally, the main air duct further includes a main air inlet connected to the upstream region, the main air inlet is located at a rear end of the intelligent hair dryer, and the air outlet is located at a front end of the intelligent hair dryer.

Optionally, the airflow detection channel collects the airflow having touched the blown object through the air inlet, and the sensor receives the airflow having touched the blown object and analyzes the state information of the airflow having touched the blown object.

Optionally, the airflow detection channel has a variable-cross-section structure with a wide front and a narrow rear, and the sensor is arranged at a position close to a rear side.

Optionally, there are at least two sensors that are arranged along an airflow flowing direction of the airflow detection channel at a set distance interval.

Optionally, the number of the airflow detection channels is set to one, two or more.

Optionally, the sensor further includes a distance sensor, and the state information of the airflow includes a movement distance of the airflow.

The present disclosure also provides a job control method, which includes:

obtaining state information of airflow having touched a blown object;

calculating state calculation information of a blown object according to the state information of the airflow;

obtaining blowing parameters of the intelligent hair dryer required by the blown object according to the state calculation information of the blown object, wherein the blowing parameters of the intelligent hair dryer include a blowing speed and a blowing temperature; and controlling the intelligent hair dryer to blow air to the blown object according to the blowing parameters of the intelligent hair dryer required by the blown object.

Optionally, the state information of the airflow includes at least one of temperature information and humidity information of the airflow, and the state calculation information of the blown object includes at least one of temperature calculation information and humidity calculation information of the blown object.

Optionally, the method further includes: obtaining current blowing parameters of the intelligent hair dryer in real time, and determining whether to adjust the blowing parameters of the intelligent hair dryer according to the current blowing parameters of the intelligent hair dryer and the blowing parameters of the intelligent hair dryer required by the blown object.

The current blowing parameters of the intelligent hair dryer are enhanced when the current blowing parameters of the intelligent hair dryer are less than the air blowing parameter of the intelligent hair dryer required by the blown object, and otherwise the current blowing parameters of the intelligent hair dryer are weakened.

Compared with the prior art, the present disclosure has following advantages.

The present disclosure provides an intelligent hair dryer, which includes an airflow detection channel, a sensor, a control system, and a main air duct. The main air duct is internally arranged with a fan unit configured to generate airflow and a heating unit configured to heat the airflow. The airflow detection channel is arranged on at least one side of the main air duct, and an air inlet of the airflow detection channel opens towards a blowing direction of the main air duct of the intelligent hair dryer. The sensor is arranged in the airflow detection channel, and is configured to detect state information of the airflow. The control system is configured to receive a detection result outputted by the sensor and to adjust the rotation speed of the fan unit and/or the heating temperature of the heating unit by using the detection result. By using the intelligent hair dryer of the present disclosure, it can ensure that the user is saved from the trouble of repeatedly adjusting the gear position of the hair dryer in the process of using the hair dryer. The intelligent hair dryer of the present disclosure adopts an intelligent mode, that is, the sensor and the control system are installed inside the intelligent hair dryer to automatically control the operation of the intelligent hair dryer by detecting the state information of the airflow, and thus the user experience is enhanced.

The present disclosure also provides a job control method. On the basis of the above intelligent hair dryer, this method automatically controls the operation of the intelligent hair dryer, so as to facilitate the use of the user.

The present disclosure also provides an intelligent hair dryer to solve the problem that the user cannot accurately know current state of the blown object, and meanwhile also to enhance the user experience. The present disclosure also provides another intelligent hair dryer and a job control method thereof. This method can save the trouble of repeatedly adjusting the gear position.

The present disclosure provides an intelligent hair dryer, which includes: a dryer body, a main air duct, an airflow detection channel, a sensor and a control system that are arranged inside the dryer body, and an indicating device arranged outside the dryer body.

The main air duct is provided with an air outlet on the dryer body and is internally arranged with an airflow generating device.

An air inlet of the airflow detection channel and the air outlet of the main air duct are arranged on the same side of the dryer body.

The sensor is arranged in the airflow detection channel and is connected with the control system, and the sensor is configured to detect state information of airflow entering the airflow detection channel.

The control system is connected with the indicating device and is configured to control the indicating device to indicate current state of a blown object according to the state information of the airflow.

Optionally, a shape of the indicating device is set to any one of a continuous or discontinuous ring-shaped structure surrounding the dryer body, and a strip-shaped structure arranged along an outer side of the dryer body.

Optionally, the sensor is a temperature sensor or a humidity sensor, and accordingly, the current state is current humidity state or temperature state of the blown object.

Optionally, the intelligent hair dryer further includes a distance sensor arranged at a side of the air outlet of the main air duct of the dryer body.

The distance sensor is connected with the control system, and is configured to detect a distance between the blown object and the air outlet.

The control system is further configured to control the indicating device to indicate the distance between the blown object and the air outlet according to a detection result of the distance sensor.

Optionally, the intelligent hair dryer further includes a collection module for operation state information of the hair dryer arranged inside the dryer body, wherein the collection module for operation state information of the hair dryer is connected with the control system.

The control system is further configured to control the indicating device to indicate operation state of the hair dryer according to the operation state information of the hair dryer collected by the collection module for operation state information.

The operation state information includes at least one of a blowing temperature, a blowing speed, blowing time, and a motor power.

Optionally, the control system is specifically configured to: control, according to information collected by the collection module for operation state information of the hair dryer, the indicating device to indicate current state of the blown object or the operation state of the hair dryer by means of any one of gradient display, monochrome display, gradient flickering, and monochrome flickering.

Optionally, the control system is specifically configured to: control, according to the detection result of the sensor, the indicating device to indicate current state of the blown object by means of any one of gradient display, monochrome display, gradient flickering, and monochrome flickering.

The present disclosure also provides an intelligent hair dryer, which includes: a dryer body, and a main air duct, an airflow detection channel, a sensor, a control system, and a display driving device that are arranged inside the dryer body.

The main air duct is provided with an air outlet on the dryer body and is internally arranged with an airflow generating device.

An air inlet of the airflow detection channel and the air outlet of the main air duct are arranged on the same side of the dryer body.

The sensor is arranged in the airflow detection channel and is connected with a processor, and the sensor is configured to detect state information of airflow entering the airflow detection channel.

The display driving device is connected with the processor, and is configured to output the current state information of the blown object to a display terminal according to the state information of the airflow. Alternatively, the display driving device is configured to output the operation state information of the hair dryer to the display terminal according to the operation state information of the hair dryer obtained by the control system.

Optionally, the intelligent hair dryer further includes a display screen arranged on an outer side of the dryer body, the display screen is connected with the display driving device, and the display screen is arranged at an end of the outer side of the dryer body opposite to the air outlet.

Optionally, the intelligent hair dryer further includes a wireless communication module, wherein the wireless communication module is connected with the display driving device, and is configured to output output information of the display driving device.

Optionally, the intelligent hair dryer further includes an indicating device arranged on the outer side of the dryer body, wherein the indicating device is connected with the processor, and is configured to indicate the current state of the blown object or the operation state of the hair dryer according to the detection result of the sensor.

The present disclosure provides a method for automatically controlling operation of an intelligent hair dryer. This method includes:

obtaining current operating power of the intelligent hair dryer and current state information of a blown object;

obtaining blowing power of the intelligent hair dryer required by the blown object according to the current state information of the blown object and a relationship between preset operating power and state information of the blown object;

determining whether to adjust the current operating power according to the current operating power of the intelligent hair dryer and the blowing power of the intelligent hair dryer required by the blown object; and adjusting or maintaining the operating power of the intelligent hair dryer according to a determination result.

Optionally, before obtaining the current operating power of the intelligent hair dryer and the current state information of the blown object, the method further includes: running the intelligent hair dryer according to initial default power.

Optionally, after running the intelligent hair dryer according to the initial default power, and before obtaining the current operating power of the intelligent hair dryer and the current state information of the blown object, the method further includes:

determining whether there exists the blown object within a specified distance from the air outlet of the intelligent hair dryer; adjusting the power of the intelligent hair dryer to minimum power if there does not exist the blown object; and obtaining the current operating power of the intelligent hair dryer and the current state information of the blown object if there exists the blown object.

Optionally, the obtaining the current state information of the blown object includes:

obtaining state information of airflow having touched the blown object; and calculating state calculation information of the blown object according to the state information of the airflow, and using the state calculation information as the current state information of the blown object.

Optionally, the state information of the airflow includes at least one of temperature information and humidity information of the airflow, and the state calculation information of the blown object includes at least one of temperature calculation information and humidity calculation information of the blown object.

An embodiment of the present disclosure also provides an information display method, which includes:

obtaining state information of airflow having touched a blown object;

determining current state of the blown object according to the state information of the airflow; and displaying the current state of the blown object.

Compared with prior art, the present disclosure has following advantages.

The present disclosure provides an intelligent hair dryer, which includes: a dryer body, a main air duct, an airflow detection channel, a sensor and a control system arranged inside the dryer body, and an indicating device arranged outside the dryer body. The main air duct is provided with an air outlet on the dryer body and is internally arranged with an airflow generating device. An air inlet of the airflow detection channel and the air outlet of the main air duct are arranged on the same side of the dryer body. The sensor is arranged in the airflow detection channel and is connected with the control system, and the sensor is configured to detect state information of airflow. The control system is connected with the indicating device and is configured to control the indicating device to indicate current state of a blown object according to a detection result of the sensor. By installing the indicating device on the dryer body of the intelligent hair dryer and indicating the current state of the blown object, this method can allow the user to accurately and intuitively obtain the current state of the blown object of the hair dryer.

BRIEF DESCRIPTION OF THE DRAWINGS

The accompanying drawings described herein are intended for providing further understanding of the present disclosure, and constituting a part of the present disclosure. The exemplary embodiments of the present disclosure and description thereof are intended for explaining the present disclosure, and do not constitute improper limitations to the present disclosure. In the accompanying drawings.

DETAILED DESCRIPTION

Figure 1:
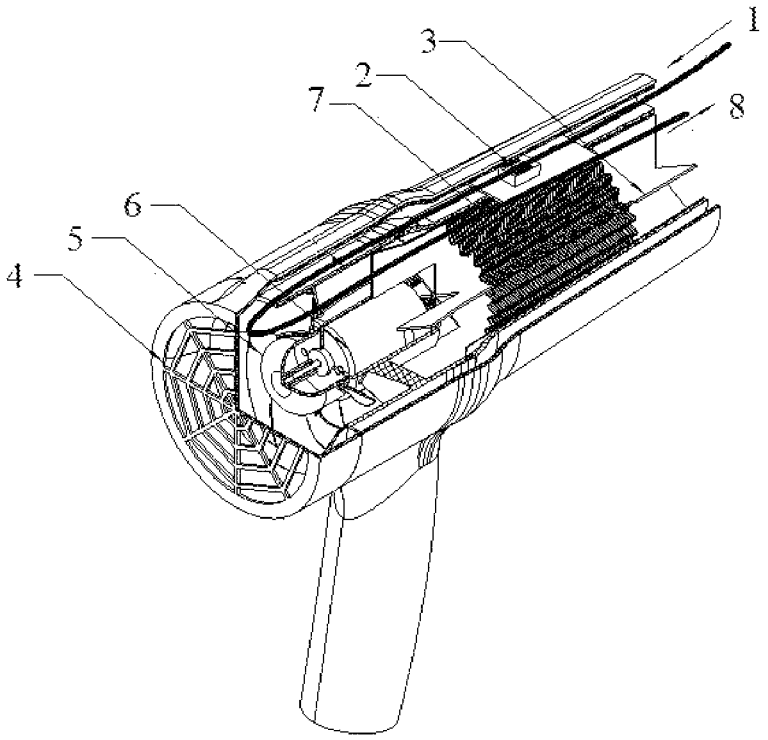
FIG. 1 is a schematic structural diagram of an intelligent hair dryer according to a first embodiment of the present disclosure.

To make the objectives, technical solutions, and advantages of the present disclosure clearer, the technical solutions of the present disclosure will be described clearly and completely below with reference to the embodiments and the corresponding accompanying drawings of the present disclosure. Apparently, the described embodiments are not all embodiments but part of embodiments of the present disclosure. All other embodiments obtained by those of ordinary skill in the art based on the embodiments in the present disclosure without creative work shall fall within the protection scope of the present disclosure.

The technical solution provided by each embodiment of the present disclosure will be described in detail below with reference to the accompanying drawings.

It is to be noted that the same reference numerals denote the same objects in the following drawings and embodiments. Therefore, once an object is defined in a drawing or an embodiment, it does not need to be further discussed in the subsequent drawings and embodiments.

The present disclosure provides an intelligent hair dryer and a related job control method. The intelligent hair dryer and the method for automatically controlling operation of the intelligent hair dryer of the present disclosure are described below with reference to specific embodiments.

As shown in FIG. 1, the first embodiment is a schematic structural diagram of an intelligent hair dryer provided by the present disclosure. The intelligent hair dryer includes: an airflow detection channel 1, a sensor 2, a control system, and a main air duct 3. The main air duct 3 is internally arranged with a fan unit configured to generate airflow and a heating unit configured to heat the airflow. In this embodiment, the fan unit and the heating unit respectively correspond to a fan 5 and a heating wire 7 in FIG. 1. In an internal structure of the intelligent hair dryer of the present disclosure, the airflow detection channel 1 is connected to an upstream region of the fan unit, and an air outlet 8 of the main air duct 3 is located in a downstream region of the fan unit, such that the airflow inside the airflow detection channel 1 moves to the air outlet 8 of the main air duct 3 after passing through the fan unit. The principle of the airflow movement in the above process is described as follows. When the intelligent hair dryer is in operation, a negative pressure may be formed in the upstream region of the fan unit (i.e., the fan 5), and because the airflow detection channel 1 is connected to the upstream region of the fan unit, the airflow can be automatically sucked into the airflow detection channel 1 through an air inlet of the airflow detection channel 1, and then the airflow may move to the air outlet 8 of the main air duct 3 after passing through the fan unit under the action of the fan 5.

In this embodiment, the sensor 2 is arranged in the airflow detection channel 1. The sensor 2 can detect state information of the airflow entering the airflow detection channel 1. In this embodiment, the air inlet of the airflow detection channel 1 opens towards a blowing direction of the main air duct 3 of the intelligent hair dryer. In this way, when the intelligent hair dryer blows air to a blown object, the airflow having touched the blown object can enter the airflow detection channel 1 through the air inlet of the airflow detection channel 1, and flow in the airflow detection channel 1 to touch the sensor 2. In this way, the sensor 2 may collect the state information of the airflow having touched the blown object. Since the airflow having touched the blown object carries the state information of the blown object, the state information of the airflow having touched the blown object may reflect the state information of the blown object. The state information of the airflow includes at least one of temperature information and humidity information of the airflow. The temperature information of the airflow may be relative or absolute temperature information of the airflow; and the humidity information of the airflow may be relative or absolute humidity information of the airflow, etc. Correspondingly, the state information of the blown object may also be at least one of temperature information and humidity information.

Further, the sensor 2 can provide the state information of the airflow having touched the blown object to the control system. Further, the control system can control operation state of the intelligent hair dryer according to the state information of the airflow, i.e., using the state information of the airflow to control the operation state of the intelligent hair dryer.

Optionally, the control system can determine the state information of the blown object according to the state information of the airflow having touched the blown object, and can control the operation state of the intelligent hair dryer according to the state information of the blown object.

The hair dryer provided by this embodiment can obtain the state information of the airflow having touched the blown object, and the state information may reflect the state information of the blown object at a certain extent. Therefore, by controlling the operation state of the intelligent hair dryer according to the state information of the airflow, the operation state of the intelligent hair dryer may adapt to the state of the blown object, and thus the operation state of the hair dryer can be automatically adjusted without manual adjustment by the user, thereby helping to improve the user experience.

In the intelligent hair dryer of the present disclosure, the airflow detection channel 1 is arranged on at least one side of the main air duct 3, and the airflow detection channel 1 may be arranged at any position around the main air duct 3. For example, the airflow detection channel 1 may be arranged on an upper side, a lower side, a left side or a right side of the main air duct 3, and the number of the airflow detection channel 1 is at least one. FIG. 1 only illustrates a case where the airflow detection channel 1 is arranged on the upper side of the main air duct 3, but it does not limit the arrangement position and the number of the airflow detection channel 1.

Specifically, the airflow detection channel 1 collects the airflow having touched the blown object through the air inlet of the airflow detection channel 1. To better suck in the airflow having touched the blown object for the intelligent hair dryer, in practice, the airflow detection channel 1 may be set to a variable-cross-section structure with a wide front and a narrow rear. That is, the air inlet of the airflow detection channel 1 is set to the widest part of the entire airflow detection channel 1, the sensor 2 may be arranged at a position close to a rear side of the airflow detection channel 1, and the inside of the airflow detection channel 1 gradually narrows, which can ensure that after the airflow having touched the blown object is sucked into the airflow detection channel 1, the airflow is relatively concentrated, thereby helping to maintain the temperature and humidity of the airflow. Meanwhile, the sensor 2 may be arranged at the position close to the rear side of the airflow detection channel 1, such that sensitive elements in the sensor 2 can fully touch denser airflows to obtain better measurement results.

To detect and analyze the state information of the airflow having touched the blown object at a plurality of positions in the airflow detection channel 1, two or more sensors 2 may be arranged in the airflow detection channel 1. In an embodiment of the present disclosure, "more" refers to three or more than three. The sensor 2 can detect the temperature information and humidity information of the airflow, or detect one of the temperature information and humidity information. Specifically, when the airflow is sucked into the airflow detection channel 1, the airflow may flow in the airflow detection channel 1, and then may touch the sensor 2. Correspondingly, temperature and humidity response devices in the sensor 2 may detect temperature and humidity of the airflow due to touch the airflow.

The above process of forming the airflow having touched the blown object is described as follows. The main air duct 3 of the intelligent hair dryer of the present disclosure is provided with a main air inlet connected to the upstream region of the fan unit. In the process of blowing air by the intelligent hair dryer, under the action of a motor 6 and the fan 5 inside the intelligent hair dryer, the intelligent hair dryer will suck a large amount of air into the main air duct 3 from the main air inlet through a rear protective cover 4. After entering the main air duct 3 of the hair dryer, the large amount of air is heated by the heating wire 7 inside the hair dryer, and finally is blown out from the air outlet 8 of the main air duct 3 of the hair dryer. A large amount of air is blown toward the blown object through the hair dryer, and a small amount of air may enter the airflow detection channel 1 through the air inlet of the airflow detection channel 1 after touching the blown object. Both the area of the main air inlet of the main air duct 3 and the area of the air outlet 8 of the main air duct 3 in the present disclosure are larger than the area of the air inlet of the airflow detection channel 1, so only a small part of the airflow enters the airflow detection channel 1, which basically does not affect the blowing effect of the hair dryer. Meanwhile, this small part of the airflow is a part of airflow that is turned back after touching the blown object in the large amount of air. Therefore, the state information of the airflow can reflect the state information of the blown object. The state information of the blown object may be at least one of the temperature information and humidity information of the blown object. In real life, hair dryers are widely used, and the following takes the process of drying hair by the intelligent hair dryer of this embodiment as an example for description.

As shown in FIG. 1, the rear protective cover 4 is installed at a rear end of the intelligent hair dryer of this embodiment, and the rear end of the intelligent hair dryer is provided with the main air inlet of the main air duct 3. Correspondingly, the air outlet 8 of the main air duct 3 is located at a front end of the intelligent hair dryer. After the intelligent hair dryer is started for intelligent operation, the fan 5 of the intelligent hair dryer is started. Driven by the motor 6, the intelligent hair dryer can suck a large amount of air from the main air inlet of the main air duct 3 into the main air duct 3 through the rear protective cover 4. After entering the main air duct 3 of the hair dryer, the large amount of air is heated by the heating wire 7 inside the hair dryer and blown out from the air outlet 8 of the main air duct 3 of the hair dryer. A large amount of air is blown toward the hair through the hair dryer, and a small amount of air may enter the airflow detection channel 1 through the air inlet of the airflow detection channel 1 after touching the hair. Since the small amount of air is a part of airflow that is turned back after touching the hair in the large amount of air, the airflow can reflect the real temperature and humidity of the hair. Subsequently, the airflow flows through the sensor 2. The sensor 2 may obtain the state information of the airflow having touched the hair, and provide the state information of the airflow to the control system. Further, the control system can determine the state information of the hair based on the state information of the airflow, and control the operation state of the intelligent hair dryer according to the state information of the hair.

In this embodiment, the sensor 2 may be arranged at any position of the airflow detection channel 1. In actual installation, the sensor 2 may be arranged at the air inlet of the airflow detection channel 1, inside the airflow detection channel 1 or other positions. Of course, a plurality of sensors may be installed at the same time. For example, the sensor 2 is arranged at a position close to the air inlet of the airflow detection channel 1, and the sensor 2 arranged at the position close to the air inlet of the airflow detection channel 1 can touch the airflow having touched the hair in a short time. Therefore, the sensor 2 can more accurately detect the temperature information and humidity information of the airflow having touched the hair. When the sensor 2 is arranged inside the airflow detection channel 1, especially when the sensor 2 is arranged in the narrowest part of an internal channel of the airflow detection channel 1, the airflow is most concentrated here, because the internal channel of the airflow detection channel 1 is a structure with a wide front and a narrow rear. Therefore, the sensor 2 installed in the narrowest part can respond most quickly to the temperature information and the humidity information of the airflow having touched the hair. Alternatively, the sensor 2 is arranged at different positions of the airflow detection channel 1 according to a set distance interval, to detect the temperature information and the humidity information of the airflow at different positions. By arranging the sensor 2 at different positions as mentioned above, temperature change information and humidity change information of the airflow flowing through different positions inside the intelligent hair dryer may be detected, so as to fit the temperature parameter and humidity parameter of the airflow flowing inside the intelligent hair dryer, and to further calculate state calculation information of the hair including at least one of temperature calculation information and humidity calculation information of the hair, so that air blown out from the air outlet 8 of the main air duct by the intelligent hair dryer of the present disclosure is more suitable for the blowing required by the blown object.

In the intelligent hair dryer of the present disclosure, in order to calculate the state calculation information of the hair, in addition to being required to obtain the temperature information and humidity information of the airflow flowing through inside the airflow detection channel 1, it is also required to obtain the blowing temperature and blowing speed of the hair dryer before the air blown by the hair dryer touches the hair, that is, the temperature and speed at which the hair dryer is blowing air. There are many ways to obtain the blowing temperature and blowing speed of the hair dryer. For example, the blowing temperature may be detected by arranging the sensor at any position of the main air duct 3, for example, by arranging a temperature sensor at the position of the air outlet 8. Alternatively, when the intelligent hair dryer is blowing air, under an operating gear position of the hair dryer, there exists a theoretical temperature corresponding to the operating gear position. Therefore, the blowing temperature of the hair dryer may be speculated based on the theoretical temperature corresponding to the operating gear position of the hair dryer. Similarly, the blowing speed of the hair dryer may also be obtained according to the above method of obtaining the blowing temperature, and thus repeated description is omitted herein.

After the blowing temperature and blowing speed of the hair dryer, as well as the temperature information and humidity information of the airflow flowing through the inside of the airflow detection channel 1 are obtained, fitting can be performed according to the above parameters, to obtain state calculation information of the hair. That is, the state calculation information of the hair is obtained by using temperature change information and humidity change information of the airflow before and after touching the hair. More specifically, the state calculation information of the hair may be obtained by multiple fitting methods. Two fitting methods are illustrated as below.

In the first fitting method, fitting is performed by a formula method. Specifically, after the blowing temperature and blowing speed of the hair dryer, as well as the temperature information and humidity information of the airflow flowing through the inside of the airflow detection channel 1 are obtained, a relationship between the above parameters and the state information of the hair is established. In the actual operation of establishing the relationship, multiple experiments may be carried out. Experiment contents include, but are not limited to, detecting the state information of the hair in different time, the corresponding blowing temperature and blowing speed of the hair dryer, and the corresponding temperature information and humidity information of the airflow flowing through the inside of the airflow detection channel 1, or replacing different blown objects and detecting the state information of the different blown objects, the corresponding blowing temperature and blowing speed of the hair dryer, and the corresponding temperature information and humidity information of the airflow flowing through the inside of the airflow detection channel 1. After a large amount of the above corresponding data are obtained, a functional relationship between the above detected parameters and the state information of the blown objects may be established, and this functional relationship is used as an empirical formula, wherein the detected parameters include the blowing temperature and blowing speed of the hair dryer, and the temperature information and humidity information of the airflow flowing through the inside of the airflow detection channel 1, and so on. After the empirical formula is obtained, the state information of the hair may be calculated only by substituting the blowing temperature and blowing speed of the hair dryer, and the temperature information and humidity information of the airflow flowing through the inside of the airflow detection channel 1 into the empirical formula.

In the second fitting method, a table is made, in which the above detected parameters and the state information of the blown object are in a one-to-one correspondence, and then the state information of the hair may be calculated only by querying, from the table, the blowing temperature and blowing speed of the hair dryer, and the temperature information and humidity information of the airflow flowing through the inside of the airflow detection channel 1.

To detect the state information of the airflow more comprehensively, a distance sensor may also be arranged in the above sensor, through which a movement distance of the airflow in the state information of the airflow can be detected. The distance sensor may be implemented in a variety of ways. For example, a laser direct structuring (LDS) lidar ranging device may be arranged on the head of the hair dryer. The movement distance of the airflow may be defined as a distance from the air outlet to the blown object (e.g., the hair), or a distance from the air outlet to the blown object and then from the blown object to the air inlet of the airflow detection channel 1. The temperature and humidity, etc. detected by the sensor in the airflow detection channel are merely temperature and humidity of the airflow in the airflow detection channel, which are different from a temperature parameter and a humidity parameter of the blown object that are really expected to be obtained, and the distance between the hair dryer and the blown object has a great influence on the differences of the temperature parameter and the humidity parameter. Therefore, a measurement result of the distance sensor may be applied to the above fitting methods as an important parameter for use.

To allow the airflow flowing through the airflow detection channel 1 to form a circulating airflow, the air outlet of the airflow detection channel 1 may be provided in an upstream of the main air duct 3. That is, the airflow detection channel 1 is connected to the upstream region of the fan 5. This connection method may be interpreted as follows. A low air pressure in the upstream of the main air duct 3 is introduced to the air inlet of the airflow detection channel 1, and after the airflow having touched the blown object is blocked back, the airflow is more likely to flow back to the upstream region of the main air inlet through the airflow detection channel 1, and merges with a large amount of air sucked into from the main air inlet, and then under the action of the fan 5, the merged air is blown out from the air outlet 8 of the main air duct 3 through the main air duct 3. By the above process, the airflow having touched the hair may form an airflow channel circulating through the airflow detection channel 1.

To better detect the change of the temperature and humidity of the airflow, a sensor 2 may also be installed at the air outlet 8 of the main air duct 3 of the intelligent hair dryer. Further, the sensor 2 installed at the air outlet 8 of the intelligent hair dryer, a sensor 2 installed at the air inlet of the airflow detection channel 1, and a sensor 2 installed inside the airflow detection channel 1 can perform a continuous gradient temperature and humidity measurement on operation and detection airflows of the hair dryer, and can more accurately calculate the temperature condition and humidity condition of the blown object on this basis, so as to provide more accurate information for controlling the operation of the intelligent hair dryer by the control system.

Similarly, two or more sensors may be arranged in the airflow detection channel 1, and these sensors are arranged in an airflow flowing direction of the airflow detection channel at a set distance interval. In this way, a gradient measurement effect of the detection airflow may also be obtained, and thus the temperature state and humidity state of the blown object can be more accurately calculated.

After the sensor 2 obtains the temperature information and humidity information of the airflow having touched the hair, the sensor 2 transmits the temperature information and humidity information of the airflow having touched the hair to the control system of the intelligent hair dryer. The control system is configured to receive a detection result outputted by the sensor, and use the detection result to adjust a rotation speed of the fan unit and/or a heating temperature of the heating unit. In this embodiment, the above adjustment of the rotation speed of the fan unit and/or the heating temperature of the heating unit corresponds to the adjustment of the rotation speed of the fan 5 and/or the heating temperature of the heating wire 7 in FIG. 1. Specifically, the control system further includes a controller configured to receive the temperature information and humidity information detected by each sensor 2 and the temperature change information and humidity change information of the airflow before and after touching the hair, and to control the blowing parameters of the intelligent hair dryer through a preset program, wherein the blowing parameters of the intelligent hair dryer include the blowing speed and the blowing temperature. More specifically, "the controller controls the blowing parameters of the intelligent hair dryer" means that the controller controls the blowing speed and the blowing temperature of the intelligent hair dryer by controlling the rotation speed of the fan 5 and the heating of the heating wire 7, respectively. In practice, the above blowing speed and blowing temperature are embodied as blowing air volume and cool or hot of the blown air.

In a specific implementation of the control system of the intelligent hair dryer, the above control process may be performed as below. A control chip is arranged inside the intelligent hair dryer, and the control chip receives the temperature information and humidity information of the airflow having touched the hair and the temperature change information and humidity change information of the airflow before and after touching the hair transmitted by each sensor 2, and performs data conversion according to the temperature information and humidity information of the airflow having touched the hair and the temperature change information and the humidity change information of the airflow before and after touching the hair, to obtain the temperature and humidity of the user's hair. Then, the control chip controls the blowing parameters of the intelligent hair dryer through a preset program according to the temperature information and humidity information of the user's hair obtained through conversion, and adjusts the actual air blowing situation of the intelligent hair dryer based on the blowing parameters, that is, adjusts the blowing of the intelligent hair dryer.

For example, in the above control process, the preset program may be as below. First, the blowing parameters required by the blown object is calculated periodically or in real time according to the temperature information and humidity information of the user's hair obtained through conversion by the control chip. In addition, it is also required to obtain current blowing parameters of the intelligent hair dryer, wherein the blowing parameters at least include the blowing speed and the blowing temperature. After the blowing parameters required by the blown object and the current blowing parameters of the intelligent hair dryer are obtained, the blowing parameters required by the blown object and the current blowing parameters of the intelligent hair dryer are compared, and the actual blowing situation of the intelligent hair dryer is adjusted according to the comparison result. In this process, the intelligent hair dryer automatically calculates the blowing parameters and automatically adjusts the blowing situation of the intelligent hair dryer, which saves the user from the cumbersome manual change of the gear position and improves the user experience.

Specifically, the blowing parameters required by the blown object in the above preset program are blowing parameters required by the blown object determined according to the current airflow having touched the hair sucked by the airflow detection channel 1. If the current blowing parameters of the intelligent hair dryer are less than the blowing parameters required by the blown object, that is, if the current blowing speed and blowing temperature are less than the blowing speed and blowing temperature required by the blown object, the control system increases the power of the motor of the hair dryer to automatically enhance the blowing air volume and blowing temperature of the intelligent hair dryer. For example, the control system may increase the rotation speed of the motor of the fan 5 and the heating power of the heating wire 7. If the current blowing parameters of the intelligent hair dryer are greater than the blowing parameters required by the hair to be blown, that is, if the current blowing speed and blowing temperature are greater than the blowing speed and blowing temperature required by the hair to be blown, the control system may decrease the power of the hair dryer to automatically weaken the blowing air volume and blowing temperature of the intelligent hair dryer. For example, the rotation speed of the motor of the fan 5 and the heating power of the heating wire 7 may be decreased for the intelligent hair dryer. During the operation of the intelligent hair dryer, the airflow detection channel 1 sucks in the airflow having touched the hair in real time or periodically, so after the intelligent hair dryer blows air for a period of time, the temperature information and humidity information of the airflow having touched the hair may change. That is, the temperature information and humidity information of the user's hair obtained through conversion by the control chip may also change. In the actual blowing process of the intelligent hair dryer, the temperature and humidity of the hair also change in real time. As the blowing time increases, the humidity of the hair continuously decreases, and the temperature of the hair continuously increases. Therefore, the operation parameters of the intelligent hair dryer required by blowing the hair also continuously change in this process. For example, in the process of continuously drying the hair, both the required air volume and temperature provided by the intelligent hair dryer gradually decrease. That is, the blowing parameters required by the hair to be blown continuously decrease. Accordingly, the control system needs to continuously or periodically adjust the parameters of the intelligent hair dryer to meet the needs of the blown object.

The above control chip obtains the temperature and humidity of the user's hair through data conversion, which is mainly achieved according to the temperature information and humidity information of the airflow having touched the hair and the temperature change information and the humidity change information of the airflow before and after touching the hair transmitted by each sensor 2. Among various sensors in each of the above installation positions, the temperature information and humidity information detected by the sensor 2 installed at the air inlet of the airflow detection channel 1 of the intelligent hair dryer is closest to the temperature and humidity of the hair, the sensor 2 installed in the narrowest part of the airflow detection channel 1 can most quickly sense the temperature and humidity of the airflow having touched the hair through the airflow detection channel 1, and the sensor 2 installed at the air outlet 8 of the main air duct 3 can sense the temperature information and humidity information of the airflow blown through the main air duct 3.

An intelligent gear position button is provided in a hand-held part of the intelligent hair dryer of the present disclosure. When using the intelligent hair dryer, the user only needs to adjust the intelligent hair dryer to an intelligent gear position, and the intelligent hair dryer of the present disclosure can intelligently adjust the air speed and the temperature of the hair dryer according to the sensor and control chip, thereby saving the user from adjusting the gear position of the hair dryer multiple times and enhancing the user experience.

In the above embodiment, there is provided an intelligent hair dryer, and correspondingly, a second embodiment of the present disclosure provides a job control method.

Figure 2:
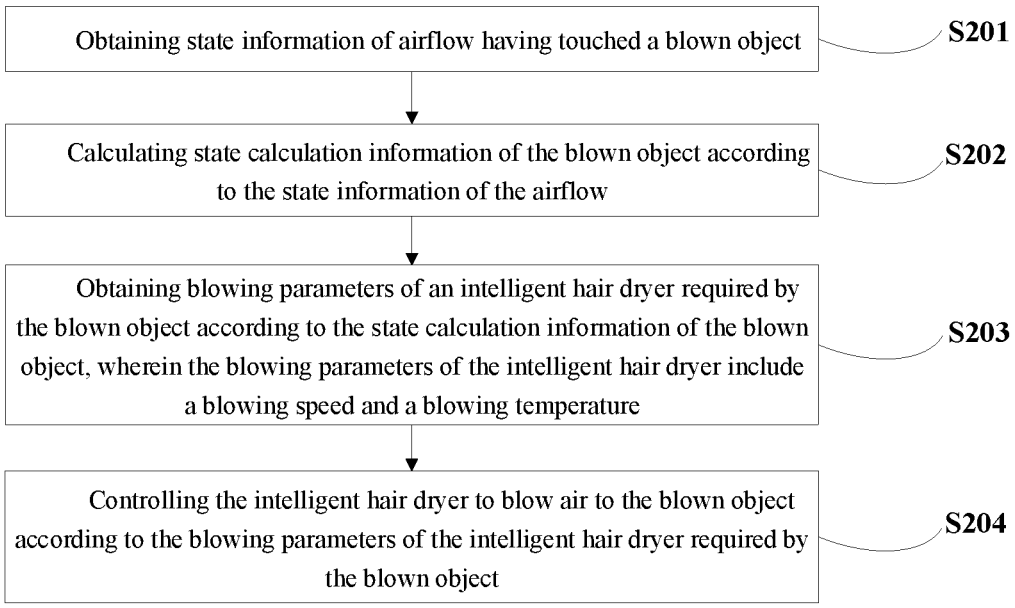
FIG. 2 is a method flowchart of a job control method according to a second embodiment of the present disclosure.

As shown in FIG. 2, a flowchart of the job control method provided by the second embodiment of the present disclosure is illustrated. A method embodiment is basically similar to an apparatus embodiment, so the description of the method embodiment is relatively simple, and reference may be made to the description of the apparatus embodiment for relevant parts. The following description of the method embodiment is merely exemplary.

The job control method provided by the second embodiment of the present disclosure is as shown in FIG. 2, and this method includes steps S201 to S204 as below.

Step S201: obtaining state information of airflow having touched a blown object.

Step S202: calculating state calculation information of the blown object according to the state information of the airflow.

Step S203: obtaining blowing parameters of the intelligent hair dryer required by the blown object according to the state calculation information of the blown object, wherein the blowing parameters of the intelligent hair dryer includes a blowing speed and a blowing temperature.

Step S204: controlling the intelligent hair dryer to blow air to the blown object according to the blowing parameters of the intelligent hair dryer required by the blown object.

Optionally, the state information of the airflow includes at least one of temperature information and humidity information of the airflow, and the state calculation information of the blown object includes at least one of temperature calculation information and humidity calculation information of the blown object.

Optionally, the method further includes: obtaining current blowing parameters of the intelligent hair dryer in real time, and determining whether to adjust the blowing parameters of the intelligent hair dryer according to the current blowing parameters of the intelligent hair dryer and the blowing parameters of the intelligent hair dryer required by the blown object.

The current blowing parameters of the intelligent hair dryer are enhanced when the current blowing parameters of the intelligent hair dryer are less than the blowing parameters of the intelligent hair dryer required by the blown object, and otherwise, the current blowing parameters of the intelligent hair dryer are weakened.

In the above method for automatically controlling the operation of the intelligent hair dryer, by using humidity information and/or temperature information obtained by the sensor arranged in the airflow detection channel in the intelligent hair dryer provided by the first embodiment of the present disclosure, intelligent control of the operation of the hair dryer is implemented, and the use experience of the hair dryer is efficiently improved.

Although the present disclosure is disclosed as above with preferred embodiments, the present disclosure is not limited thereto. Any person skilled in the art can make possible variations and modifications without departing from the spirit and scope of the present disclosure. Therefore, the protection scope of the present disclosure shall be subject to the scope defined by the claims of the present disclosure.

An embodiment of the present disclosure also provides a computer-readable storage medium with computer instructions stored therein. When the computer instructions are executed by one or more processors, the one or more processors are caused to execute the steps in the above job control method.

The present disclosure respectively provides an intelligent hair dryer and a related job control method. The intelligent hair dryer and the job control method of the present disclosure are described below with reference to specific embodiments.

Figure 3:
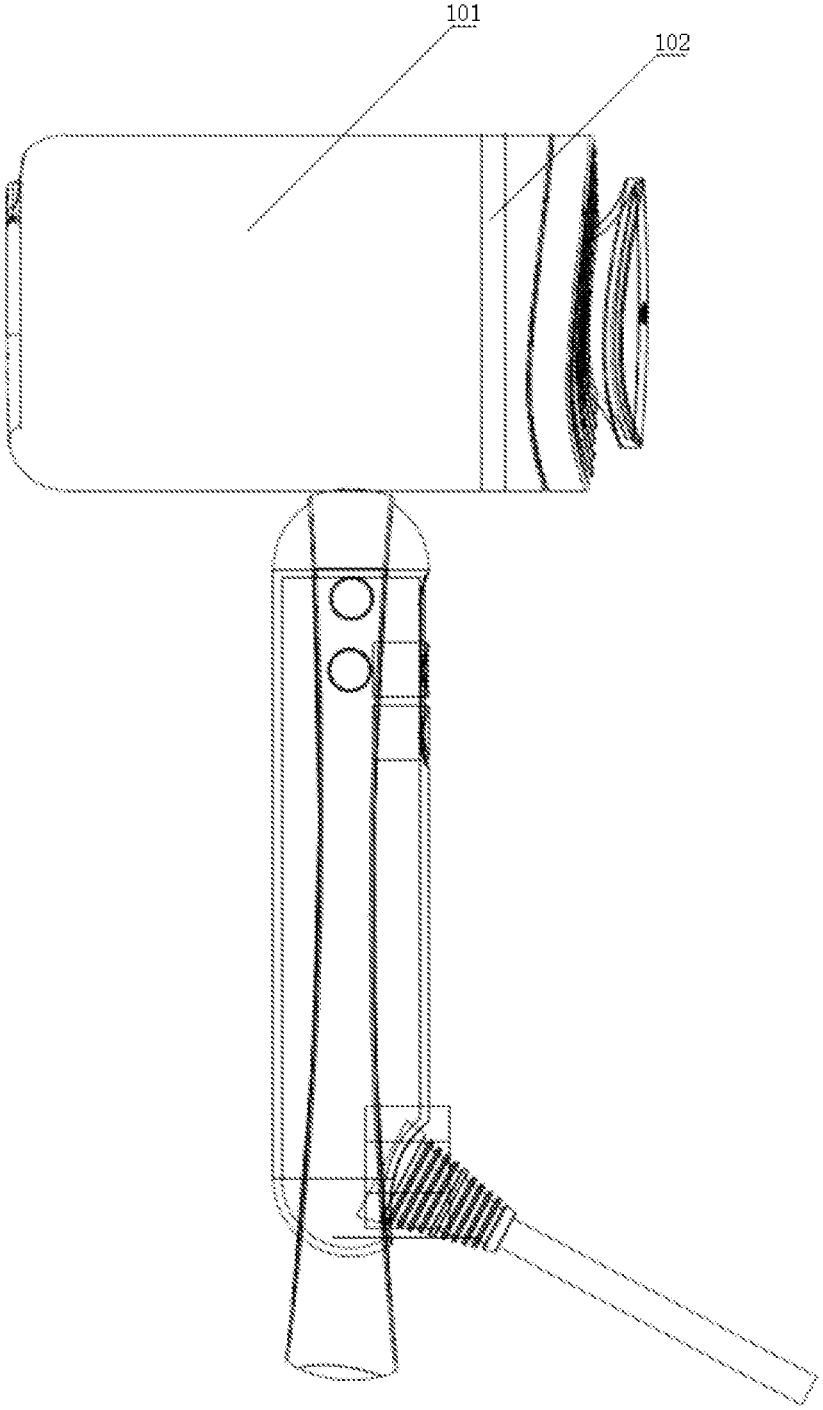
FIG. 3 is a schematic structural diagram showing the periphery of the intelligent hair dryer according to the first embodiment of the present disclosure.
Figure 4:
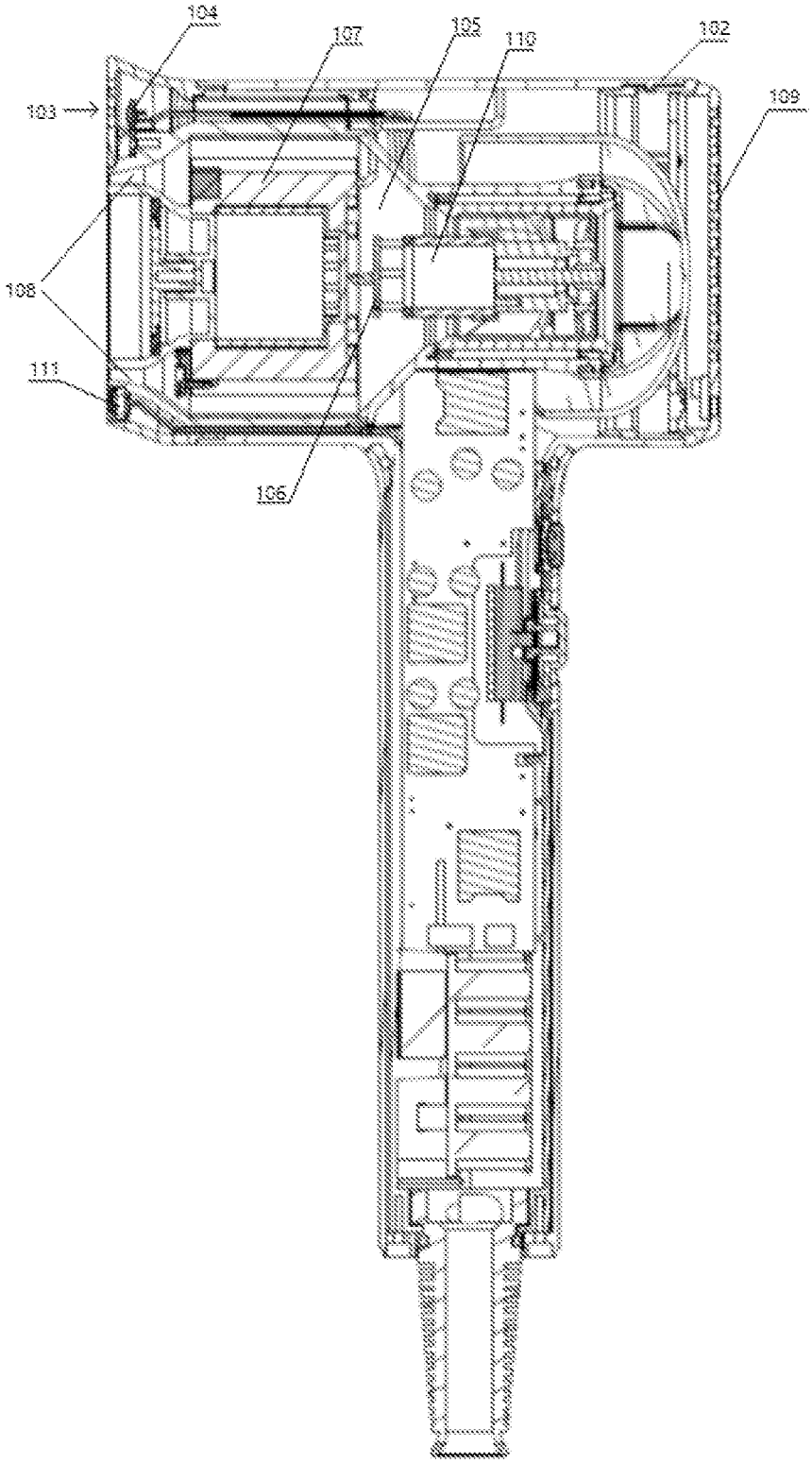
FIG. 4 is a sectional view of the intelligent hair dryer according to the first embodiment of the present disclosure.

As shown in FIG. 3 and FIG. 4, FIG. 3 is a schematic structural diagram of an intelligent hair dryer according to a first embodiment of the present disclosure, and FIG. 4 is a sectional view of the intelligent hair dryer according to the first embodiment of the present disclosure. The intelligent hair dryer includes: a dryer body 101, a main air duct 105, an airflow detection channel 103, a sensor 104 and a control system (not shown in the figures) arranged inside the dryer body 101, and an indicating device 102 arranged outside the dryer body 101. The main air duct 105 is provided with an air outlet 108 on the dryer body 101 and is internally arranged with an airflow generating device. An air inlet of the airflow detection channel 103 and the air outlet 108 of the main air duct 105 are arranged on the same side of the dryer body 101. "The air inlet of the airflow detection channel 103 and the air outlet 108 of the main air duct 105 are arranged on the same side of the dryer body 101" means that the air inlet of the airflow detection channel 103 and the air outlet 108 of the main air duct 105 are arranged on a side opposite to the air inlet of the main air duct 105. The sensor is arranged inside the airflow detection channel and is connected with the control system, and is configured to detect state information of airflow entering the airflow detection channel 103.

In this embodiment, the air inlet of the airflow detection channel 103 opens towards a blowing direction of the main air duct 105 of the intelligent hair dryer. In this way, when the intelligent hair dryer blows air to a blown object, the airflow having touched the blown object may enter the airflow detection channel 103 through the air inlet of the airflow detection channel 103, and flow inside the airflow detection channel 103 to touch the sensor 104. In this way, the sensor 104 may collect the state information of the airflow having touched the blown object. The airflow having touched the blown object carries state information of the blown object, thus the state information of the airflow having touched the blown object may reflect the state information of the blown object. Reference may be made to the related contents of the above embodiments for the description of the state information of the airflow, and thus repeated description is omitted herein. Further, the sensor 104 may provide the state information of the airflow having touched the blown object to the control system.

Further, the control system is connected with the indicating device 102, and is configured to control the indicating device 102 to indicate current state of the blown object according to a detection result of the sensor. That is, the control system may control, according to the state information of the airflow, the indicating device 102 to indicate the current state of the blown object. In this way, the user may intuitively know the current state of the blown object, thereby helping to improve the user experience.

In this embodiment, the indicating device 102 may use an indicating light, an LED display screen, a liquid crystal display screen, or an OLED display screen, etc., but the indicating device 102 is not limited thereto. The display screen used by the indicating device 102 may be a flat screen or a curved screen. Further, the indicating device 102 may use any one of the following shapes, including: a continuous or discontinuous ring-shaped structure surrounding the dryer body, and a strip-shaped structure arranged along an outer side of the dryer body.

The reason why the indicating device in this embodiment can display the current state of the blown object is mainly based on the airflow detection on the blown object by the sensor installed on the intelligent hair dryer. The sensor mainly includes at least one of a temperature sensor and a humidity sensor. The temperature sensor is mainly configured to detect the current temperature of the blown object, and the humidity sensor is mainly configured to detect the current humidity of the blown object.

Further, a distance sensor 111 is installed on a side of the air outlet of the main air duct of the intelligent hair dryer, and the distance sensor 111 is connected to the control system. In one aspect, the distance sensor may be configured to determine whether there exists a blown object. In another aspect, when there exists the blown object, the distance sensor may be configured to detect a distance between the blown object and the air outlet of the main air duct. After the distance sensor 111 detects the distance between the blown object and the air outlet, the control system can issue a corresponding control instruction according to the detection result of the distance sensor 111. The control instruction includes at least one of: adjusting power, controlling a display device to display the distance between the blown object and the air outlet, and controlling the indicating device 102 to indicate the distance between the blown object and the air outlet.

The intelligent hair dryer of this embodiment uses the sensor to obtain the current state information of the blown object, and displays the current state information of the blown object on the indicating device 102. In addition, the intelligent hair dryer may also use a collection module for operation state information of the hair dryer installed inside the dryer body to collect the operation state of the hair dryer, and display the operation state information of the hair dryer on the indicating device 102. The collection module for operation state information of the hair dryer includes: a distance sensor, an acceleration sensor, a negative ion generating device, a blowing temperature sensor, a blowing speed sensor, and a motor detection module. These information collection modules are respectively connected with the control system, and feed back the collected signals to the control system. The control system sends corresponding signals to the indicating device 102 or a drive unit of the display device, and the drive unit drives the indicating device 102 or a display unit of the display device to display various corresponding state information.

The operation state of the hair dryer is collected through the collection module for operation state information of the hair dryer and is displayed on the indicating device 102 in the manner described below. The collection module for operation state information of the hair dryer is connected with the control system, and the control system controls the indicating device 102 to indicate the operation state of the hair dryer according to the operation state information collected by the collection module for operation state information. In this embodiment, the operation state information of the intelligent hair dryer includes at least one of a distance between the intelligent hair dryer and the blown object, acceleration of the hair dryer, a concentration of negative ions, a blowing temperature, a blowing speed, blowing time, or a motor power.

The control system may concurrently control the indicating device 102 to display the various information collected by the collection module for operation state information of the hair dryer. Alternatively, when the various information collected by the collection module for operation state information of the hair dryer needs to be outputted to the indicating device 102 in a single manner, the control system may also prioritize the various information according to preset instructions, or output single display state according to the current state change of the hair dryer. For example, when the distance sensor detects that there is no blown object, after the collection module for operation state information of the hair dryer outputs the above-mentioned various information to the control system, the control system outputs the information indicating that there is no blown object to the drive unit of the indicating device 102 according to the highest priority, and the drive unit drives the indicating device 102 to display specific state indicating that there is no blown object. When the distance sensor detects that there is a blown object, and the temperature sensor and the humidity sensor detect that the blown object has a low temperature and a high humidity, the acceleration sensor detects that the acceleration is increasing, the blowing temperature sensor detects that the blowing temperature is low, and the blowing speed sensor detects that the blowing speed is not high. After obtaining the information, the control system determines that the user is blowing air to the blown object, and the motor power needs to be increased. Therefore, the indicating device 102 displays the state of the motor power. Further, the control system may control the indicating device 102 to display indication information indicating that the motor power may be increased. In this way, the user can know that the blowing gear position may be increased according to the indication information, thereby helping to meet the user's purpose of increasing the power and drying quickly.

In short, the control system of this embodiment can also control, according to the detection result of the sensor or the distance sensor 111 or the information collected by the collection module for operation state information of the hair dryer, the indicating device 102 to indicate the current state of the blown object or the operation state of the hair dryer in at least one of the following manners: gradient display, monochrome display, gradient flickering, or monochrome flickering. The monochrome display refers to monochrome display of colors such as red, green, blue, yellow, etc. The gradient display refers to a gradient change from one of the above-mentioned monochrome display to another monochrome display, such as gradient display from red to blue. In specific operation state, the gradient display may be the gradient change of the indicating device 102 from red to blue when the distance of the blown object gradually becomes closer. The same is true for the gradient flickering or the monochrome flickering, which will not be illustrated one by one here.

For example, the indicating device 102 in FIG. 1 may be an intelligent light ring. The indicating device 102 may use at least one of the gradient display, the monochrome display, the gradient flickering, and the monochrome flickering to intuitively display the operation state of the intelligent hair dryer and/or the current state of the blown object, so that the user can accurately know the operation state of the intelligent hair dryer and/or the current state of the blown object directly according to the observed display state of the indicating device 102.

Optionally, the indicating device 102 may be arranged on the dryer body of the intelligent hair dryer in a circle or a half circle, or it may be a ring-shaped discontinuous one-circle or half-circle structure, and a strip-shaped structure on the dryer body is also achievable. In an embodiment of the present disclosure, when the dryer body of the intelligent hair dryer has a circular structure, the indicating device 102 is arranged on an outer surface of the dryer body and extends along the surface of the dryer body of the intelligent hair dryer. When the indicating device 102 extends along an axial direction of the intelligent hair dryer, optionally, the indicating device 102 has a strip-shaped structure. When the indicating device 102 extends along a radial direction of the intelligent hair dryer, optionally, the indicating device 102 has a ring-shaped structure, and one-circle, half-circle or other ring-shaped structures are also achievable. In an embodiment of the present disclosure, no matter whether the indicating device 102 has the strip-shaped structure or the ring-shaped structure, this structure may be continuous or discontinuous. Optionally, the indicating device 102 has a continuous ring-shaped structure or a discontinuous strip-shaped structure.

The indicating device 102 is presented by means of LED or curved screen display, and may be a display device such as an LED light, a liquid crystal display, or an OLED display screen, etc. As shown in FIG. 1 and FIG. 2, to facilitate the user to observe the display state of the indicating device 102 and to know the operation state of the hair dryer in time, the indicating device 102 is arranged on the surface of the dryer body of the intelligent hair dryer, optionally on a position close to an end of the surface of the dryer body. To better present to the user for observation, the air outlet is arranged at an end of the dryer body of the intelligent hair dryer, and the indicating device 102 is arranged at another end of the dryer body opposite to the air outlet. In an embodiment of the present disclosure, the indicating device 102 may be arranged on the surface of the dryer body or may be arranged at an end of the dryer body. Optionally, the indicating device 102 is arranged at an end of the dryer body opposite to the other end of the air outlet. In other words, the air outlet is located at a front end of the dryer body, and the indicating device 102 is located at a rear end of the dryer body, and the indicating device 102 faces backwards the blowing direction, which is more conducive to observing the operation state of the intelligent hair dryer and/or the current state of the blown object. In the actual application process, when the user holds the hair dryer to blow air to the blown object, the air outlet faces towards the blown object, and the indicating device 102 arranged opposite to the other end of the air outlet faces backwards the blowing direction and faces towards the user, so that the user can observe the display state of the indicating device 102 in time.

The indicating device 102 has two operating modes, which are respectively an intelligent mode and a manual mode. In the intelligent mode, the indicating device 102 may display the operation state information of the blown object and/or the current state information of the blown object when the intelligent hair dryer is operating, and can implement synchronous display with a display device (such as a display screen) installed on the dryer body.

For example, when it is detected that the blown object has a high humidity, namely, when the hair is very wet, the intelligent light ring may display a gradient color, and the intelligent light ring may display blue when the hair is very dry. That is, the intelligent light ring displays a color gradient according to the change between dryness and humidity. In this way, the user may automatically judge the dryness or humidity of the hair, the operation progress, and whether the hair is blown-dried, etc. according to the color change of the intelligent light ring. Alternatively, when no object is detected in the intelligent operation mode, the distance sensor installed inside the intelligent hair dryer may be used to perform detection. When the user has not stopped the hair dryer or the hair dryer has been started, the intelligent light ring displays a monochrome quick flickering to remind the user to shut down the intelligent hair dryer. When no feedback (i.e., shutting down the intelligent hair dryer) from the user is obtained after predetermined time or predetermined number of times, the intelligent hair dryer is automatically shut down. Therefore, the safety of the intelligent hair dryer during use is ensured. Meanwhile, the state information of the blown object may be intuitively displayed to the user through the above process, so as to enhance the user experience.

When the intelligent hair dryer is in the manual mode, the indicating device 102 may display the operation state of the intelligent hair dryer. Optionally, in the manual mode, the intelligent light ring may flicker in gradient colors to indicate a high blowing speed and a high blowing temperature, to remind the user of paying attention to the operation safety of the hair dryer. For example, blue flickering may be used to indicate that the hair dryer is too close to or too far away from the blown object. When the hair dryer moves closer to the predetermined blown object, the closer the hair dryer is to the object, the more slowly the intelligent light ring flickers blue; and the farther the hair dryer is from the object, the more quickly the intelligent light ring flickers blue. Alternatively, when the hair dryer is blowing air to dry hair, the intelligent light ring displays blue, and when the hair dryer is blowing air to wet hair, the intelligent light ring displays a gradient color. Alternatively, the intelligent light ring displays a gradient color when the hair dryer is at a predetermined distance away from the blown object, and the intelligent light ring displays flickering red when there is no blown object.

In the manual and intelligent modes of the intelligent hair dryer, the operation state information of the intelligent hair dryer and/or the current state information of the blown object displayed by the above indicating device 102 merely serve as an exemplary description, and are not limited herein. The operation state information and/or the current state information of the blown object described above may be preset in the controller through a program, and at least one of the operation state information of the intelligent hair dryer and/or the current state information of the blown object can be displayed in different application scenarios. The user only needs to learn about various display states through the manual of the hair dryer.

To generate an operating airflow, an airflow generating unit is installed inside the hair dryer of the present disclosure, and the airflow generating unit includes a fan unit and a heating unit. With reference to FIG. 4, the main air duct 105 is internally arranged with a fan unit 106 configured to generate airflow and a heating unit 107 configured to heat the airflow. In this embodiment, the heating unit 107 may be a heating wire 107. The airflow detection channel 103 is arranged on at least one side of the main air duct 105, and the airflow detection channel 103 may be arranged at any position around the main air duct 105. For example, the airflow detection channel 103 may be arranged on an upper side, a lower side, a left side or right side of the main air duct 105, and the number of the airflow detection channel 103 is at least one. In this embodiment, the airflow detection channel 103 is arranged on the upper side of the main air duct 105, and the air inlet of the airflow detection channel 103 opens towards the blowing direction of the main air duct 105 of the intelligent hair dryer. The sensor 104 is arranged in the airflow detection channel 103, and the sensor 104 can detect airflow state information of the airflow, wherein the airflow state information includes at least one of temperature information and humidity information of the airflow, which may be, for example, relative humidity information, relative temperature information, absolute humidity information, and absolute temperature information of the airflow, etc.

Optionally, the airflow detection channel 103 collects the airflow having touched the blown object through the air inlet of the airflow detection channel 103, and obtains the state information of the airflow through the sensor 104. To better suck the airflow having touched the blown object for the intelligent hair dryer, in practice, the airflow detection channel 103 may be set as a variable cross-sectional structure with a wide front and a narrow rear. That is, the air inlet of the airflow detection channel 103 is set to the widest part of the entire airflow detection channel 103, and the sensor 104 is arranged inside the airflow detection channel 103.

To detect and analyze the state information of the airflow having touched the blown object in a plurality of positions of the airflow detection channel 103, a plurality of sensors 104 may be arranged in the airflow detection channel 103. The sensor 104 can detect the temperature information and humidity information of the airflow, or detect one of the temperature information and humidity information. Optionally, when the airflow is sucked into the airflow detection channel 103, the airflow flows in the airflow detection channel 103, and when the airflow flows to touch the sensor 104, temperature and humidity response devices in the sensor 104 may detect temperature and humidity of the airflow due to touching the airflow. The airflow in the airflow detection channel 103 is the airflow having touched the blown object and carries state information of the blown object, so the state information of the blown object may be obtained by detecting the airflow having touched the blown object.

The process of forming the airflow having touched the blown object is described as follows. In the process of blowing air by the intelligent hair dryer, under the action of the motor 110 and the fan 106 inside the intelligent hair dryer, a large amount of air may be sucked into the main air duct 105 through the main air inlet. After entering the main air duct 105 of the hair dryer, the large amount of air is heated by the heating wire 107 inside the hair dryer, and finally blown out from the air outlet 108 of the main air duct 105 of the hair dryer. A large amount of air is blown toward the blown object through the hair dryer, and after touching the blown object, a small amount of air may enter the airflow detection channel 103 through the air inlet of the airflow detection channel 103. Both the area of the main air inlet of the main air duct 105 and the area of the air outlet 108 of the main air duct 105 provided in the present disclosure are larger than the area of the air inlet of the airflow detection channel 103, so only a small part of the airflow enters the airflow detection channel 103, which basically does not affect the blowing effect of the hair dryer. Meanwhile, this small part of the airflow is a part of airflow that is turned back after touching the blown object in the large amount of air, so the airflow can truly reflect the state information of the airflow having touched by the blown object.

In real life, hair dryers are widely used, and the process of drying hair by the intelligent hair dryer of this embodiment is taken as an example for description.

As shown in FIG. 2, a rear end of the intelligent hair dryer of this embodiment is installed with a rear protective cover 109, and is provided with the main air inlet of the main air duct 105. Correspondingly, the air outlet 108 of the main air duct 105 is located at a front end of the intelligent hair dryer. After an intelligent operation of the intelligent hair dryer is started, the fan 106 of the intelligent hair dryer is started. Driven by the motor 110, the intelligent hair dryer can suck a large amount of air from the main air inlet of the main air duct 105 into the main air duct 105 through the rear protective cover 109. After entering the main air duct 105 of the hair dryer, the large amount of air is heated by the heating wire 107 inside the hair dryer, and finally blown out from the air outlet 108 of the main air duct 105 of the hair dryer. A large amount of air is blown toward the hair through the hair dryer, and after touching the hair, a small amount of airflow may enter the airflow detection channel 103 through the air inlet of the airflow detection channel 103. Since the small amount of airflow is part of airflow that is turned back after touching the hair in the large amount of air, the airflow can reflect the real temperature and humidity of the hair. Subsequently, the airflow flows through the sensor 104. The sensor 104 may obtain the state information of the airflow having touched the hair, and provide the state information of the airflow to the control system. Further, the control system can determine the state information of the hair based on the state information of the airflow, and control the indicating device 102 to indicate the current state of the hair.

In this embodiment, the sensor 104 may be arranged at any position of the airflow detection channel 103. In actual installation, the sensor 104 may be arranged at the air inlet of the airflow detection channel 103, inside the airflow detection channel 103 or other positions. Of course, a plurality of sensors may be installed at the same time. For example, the sensor 104 is arranged at a position close to the air inlet of the airflow detection channel 103, and the sensor 104 installed at the position close to the air inlet of the airflow detection channel 103 can touch the airflow having touched the hair in shortest time. Therefore, the sensor 104 can more accurately detect the temperature information and humidity information of the airflow having touched the hair. When the sensor 104 is arranged inside the airflow detection channel 103, especially when the sensor 104 is arranged in the narrowest part of an internal channel of the airflow detection channel 103, the airflow is most concentrated here, because the internal channel of the airflow detection channel 103 is a structure with a wide front and a narrower rear. Therefore, the sensor 104 installed in the narrowest part can respond most quickly to the temperature information and humidity information of the airflow having touched the hair. Alternatively, the sensor 104 is arranged on different positions of the airflow detection channel 103 at a set distance interval, to detect the temperature information and humidity information of the airflow at different positions. By arranging the sensor 104 in different positions as mentioned above, temperature change information and humidity change information of the airflow flowing through different positions inside the intelligent hair dryer may be detected, so as to fit temperature and humidity parameters of the airflow flowing inside the intelligent hair dryer, and to further calculate state calculation information of the hair, wherein the state calculation information of the hair includes at least one of temperature calculation information and humidity calculation information of the hair, so that air blown out from the air outlet 108 of the main air duct of the intelligent hair dryer of the present disclosure is more suitable for the blowing required by the blown object.

In the intelligent hair dryer of the present disclosure, to calculate the state calculate information of the hair, in addition to obtaining the temperature information and humidity information of the airflow flowing through the inside of the airflow detection channel 103, it is also required to obtain a blowing temperature and a blowing speed of the hair dryer before air blown out from the hair dryer touches the hair, that is, the temperature and speed of the air blown by the hair dryer. There are many ways to obtain the blowing temperature and blowing speed of the hair dryer. For example, the blowing temperature may be detected by arranging the sensor at any position of the main air duct 105, for example, by arranging a temperature sensor at the position of the air outlet 108. Furthermore, the temperature sensor may be arranged in a downstream direction of the heating wire 107, or a position between the heating wire 107 and the air outlet 108. Alternatively, when the intelligent hair dryer blows air, there exists a theoretical temperature corresponding to an operating gear position of the hair dryer under the operating gear position. Therefore, the blowing temperature of the hair dryer may be speculated through the theoretical temperature corresponding to the operating gear position of the hair dryer. Similarly, the blowing speed of the hair dryer may also be obtained according to the above method of obtaining the blowing temperature, and thus the repeated description is omitted herein.

After the blowing temperature and blowing speed of the hair dryer and the temperature information and humidity information of the airflow flowing through of the inside of the airflow detection channel 103 are obtained, state calculation information of the hair may be obtained by fitting according to the above parameters. That is, the state calculation information of the hair is obtained by using temperature change information and humidity change information of the airflow before and after touching the hair. Optionally, the state calculation information of the hair may be obtained by multiple fitting methods. Two fitting methods are illustrated as below.

In the first fitting method, the fitting is performed by a formula method. Optionally, after the blowing temperature and blowing speed of the hair dryer and the temperature information and humidity information of the airflow flowing through the inside of the airflow detection channel 103 are obtained, a relationship between the above parameters and the state information of the hair is established. In the actual operation of establishing the relationship, multiple experiments may be carried out. Experiment contents include, but are not limited to, detecting the state information of the hair in different time and the corresponding blowing temperature and blowing speed of the hair dryer and the corresponding temperature information and humidity information of the airflow flowing through the inside of the airflow detection channel 103, or replacing different blown objects and detecting the state information of different blown objects and the corresponding blowing temperature and blowing speed of the hair dryer and the corresponding temperature information and humidity information of the airflow flowing through the inside of the airflow detection channel 103. After obtaining a large amount of the above corresponding data, a functional relationship between the above detected parameters and the state information of the blown objects may be established, and this functional relationship is used as an empirical formula, wherein the detected parameters include the blowing temperature and blowing speed of the hair dryer and the temperature information and humidity information of the airflow flowing through the inside of the airflow detection channel 103, and so on. After the empirical formula is obtained, the state information of the hair may be calculated only by substituting the blowing temperature and blowing speed of the hair dryer and the temperature information and humidity information of the airflow flowing through the inside of the airflow detection channel 103 into the empirical formula.

In the second fitting method, a data table is formed, in which the above detected parameters and the state information of the blown objects are in a one-to-one correspondence, and the state information of the hair may be calculated only by querying, from the data table, the blowing temperature and blowing speed of the hair dryer and the temperature information and humidity information of the airflow flowing through the inside of the airflow detection channel 103.

To detect the state information of the airflow more comprehensively, a distance sensor may also be arranged in the above sensors. The distance sensor can detect a movement distance of the airflow in the state information of the airflow. Meanwhile, the distance sensor may also be configured to determine whether there is a blown object. The distance sensor may be implemented in a variety of ways. For example, an LDS lidar ranging device may be arranged on the head of the hair dryer. The movement distance of the airflow may be defined as a distance from the air outlet to the blown object (such as the hair), or a distance from the air outlet to the blown object and then from the blown object to the air inlet of the airflow detection channel 103. Humidity and temperature, etc. detected by the sensor in the airflow detection channel are only humidity and temperature of the airflow in the airflow detection channel, which are different from the temperature parameter and the humidity parameter of the blown object that are really expected to be obtained, and the distance between the hair dryer and the blown object has a great influence on the differences of the temperature parameter and the humidity parameter, so a measurement result of the distance sensor may be applied to the above fitting methods as an important parameter for use.

To allow the airflow flowing through the airflow detection channel 103 to form a circulating airflow, the air outlet of the airflow detection channel 103 may be provided in an upstream of the main air duct 105. That is, the airflow detection channel 103 is connected to the upstream region of the fan 106. This connection method may be interpreted as introducing a low air pressure in the upstream of the main air duct 105 to the air inlet of the airflow detection channel 103. After the airflow having touched the blown object is turned back, the airflow is more likely to flow back to the upstream region of the main air inlet through the airflow detection channel 103, and merges with a large amount of air sucked through the main air inlet, then under the action of the fan 106, the merged air is blown out from the air outlet 108 of the main air duct 105 through the main air duct 105. Through the above process, the airflow having touched the hair may form an airflow channel circulating through the airflow detection channel 103.

To better detect temperature change and humidity change of the airflow, a sensor 104 may also be installed at the air outlet 108 of the main air duct 105 of the intelligent hair dryer. Further, the sensor 104 installed at the air outlet 108 of the intelligent hair dryer, the sensor 104 installed at the air inlet of the airflow detection channel 103, and the sensor 104 installed inside the airflow detection channel 103 can perform a continuous gradient temperature and humidity measurement on operating airflow and detecting airflow of the hair dryer, and can more accurately calculate the temperature and humidity condition of the blown object on this basis, and provide more accurate information for controlling the operation of the intelligent hair dryer by the control system.

Similarly, two or more sensors may be arranged in the airflow detection channel 103, and these sensors are arranged in an airflow flowing direction of the airflow detection channel at a set distance interval. In this way, a gradient measurement effect of the detection airflow may also be obtained, so that the temperature state and humidity state of the blown object can be more accurately calculated.

After the sensor 104 obtains the temperature information and humidity information of the airflow having touched the hair, the sensor 104 transmits the temperature information and humidity information of the airflow having touched the hair to the control system of the intelligent hair dryer. The control system is configured to receive a detection result outputted by the sensor, and use the detection result to adjust a rotation speed of the fan unit and/or a heating temperature of the heating unit. In this embodiment, the above adjustment of the rotation speed of the fan unit and/or the heating temperature of the heating unit corresponds to adjustment of the rotation speed of the fan 106 and/or the heating temperature of the heating wire 107 in FIG. 2. Optionally, the control system further includes a controller configured to receive the temperature information and humidity information detected by each sensor 104 and the temperature change information and humidity change information of the airflow before and after touching the hair, to control the blowing parameters of the intelligent hair dryer through a preset program, wherein the blowing parameters of the intelligent hair dryer include the blowing speed and blowing temperature. Optionally, "the controller controls the blowing parameters of the intelligent hair dryer" means that the controller controls the blowing speed and blowing temperature of the intelligent hair dryer by controlling the rotation speed of the fan 106 and the heating of the heating wire 107, respectively. In practice, the blowing speed and blowing temperature are specifically embodied as blowing air volume and cool or hot of the blown air.

In a specific implementation of the control system of the intelligent hair dryer, the above control process may be performed as below. A control chip is arranged inside the intelligent hair dryer, and the control chip receives the temperature information and humidity information of the airflow having touched the hair and the temperature change information and humidity change information of the airflow before and after touching the hair transmitted by each sensor 104, and obtains the temperature and humidity of the user's hair through data conversion according to the temperature information and humidity information of the airflow having touched the hair and the temperature change information and humidity change information of the airflow before and after touching the hair. Then, the control chip controls the blowing parameters of the intelligent hair dryer through a preset program according to the temperature information and humidity information of the user's hair obtained through conversion, and adjusts the actual blowing situation of the intelligent hair dryer based on the blowing parameters, that is, adjusts the blowing power of the intelligent hair dryer.

For example, in the above control process, the preset program may be as below. First, the blowing parameters required by the blown object is calculated periodically or in real time according to the temperature information and humidity information of the user's hair obtained through conversion by the control chip. In addition, it is also required to obtain the current blowing parameters of the intelligent hair dryer, wherein the blowing parameters at least include the blowing speed and blowing temperature. After the blowing parameters required by the blown object and the current blowing parameters of the intelligent hair dryer are obtained, the blowing parameters required by the blown object and the current blowing parameters of the intelligent hair dryer are compared, and the actual blowing situation of the intelligent hair dryer is adjusted according to the comparison result. In this process, the intelligent hair dryer automatically calculates the blowing parameters and automatically adjusts the blowing situation of the intelligent hair dryer, which saves the user from the cumbersome manual change of the gear position and improves the user experience.

Specifically, the blowing parameters required by the blown object in the above preset program are the blowing parameters required by the blown object determined according to the current airflow having touched the hair sucked by the airflow detection channel 1. If the current blowing parameters of the intelligent hair dryer are less than the blowing parameters required by the blown object, that is, if the current blowing speed and blowing temperature are less than the blowing speed and blowing temperature required by the blown object, the control system may automatically increase the power of the motor of the hair dryer to enhance the blowing air volume and blowing temperature of the intelligent hair dryer. For example, the rotation speed of the motor of the fan and the heating power of the heating wire 107 in the intelligent hair dryer may be increased. If the current blowing parameters of the intelligent hair dryer are greater than the blowing parameters required by the hair to be blown, that is, if the current blowing speed and blowing temperature are greater than the blowing speed and blowing temperature required by the hair to be blown, the control system may decrease the power of the motor of the hair dryer to automatically weaken the blowing air volume and blowing temperature of the intelligent hair dryer. For example, the rotation speed of the motor of the fan and the heating power of the heating wire 107 in the intelligent hair dryer may be decreased. During the operation of the intelligent hair dryer, the airflow detection channel 103 sucks the airflow having touched the hair in real time or periodically. After the intelligent hair dryer blows air for a period of time, the temperature information and humidity information of the airflow having touched the hair may change. That is, the temperature information and humidity information of the user's hair obtained through conversion by the control chip may also change. In the actual blowing process of the intelligent hair dryer, the temperature and humidity of the hair also change in real time. As the blowing time increases, the humidity of the hair continuously decreases, and the temperature of the hair continuously increases. Therefore, the operation parameters of the intelligent hair dryer required to blow the hair also continuously change in this process. For example, in the process of continuously drying the hair, both the required air volume and temperature provided by the intelligent hair dryer gradually decrease. That is, the blowing parameters required by the hair to be blown continuously decrease. Accordingly, the control system needs to continuously or periodically adjust the parameters of the intelligent hair dryer to meet the needs of the blown object.

The above obtaining the temperature and humidity of the blown object through data conversion by the control chip is mainly achieved according to the temperature information and humidity information of the airflow having touched the blown object and the temperature change information and humidity change information of the airflow before and after touching the blown object transmitted by each sensor 104. Among various sensors in each of the above installation positions, the temperature information and humidity information detected by the sensor 104 installed at the air inlet of the airflow detection channel 103 of the intelligent hair dryer is closest to the temperature and humidity of the blown object, the sensor 104 installed in the narrowest part of the airflow detection channel 103 can most quickly sense the temperature and humidity of the airflow having touched the blown object through the airflow detection channel 103, and the sensor 104 installed at the air outlet 108 of the main air duct 105 can sense the temperature information and humidity information of the airflow blowing through the main air duct 105.

In the above description process, the intelligent hair dryer uses the sensors to obtain the current state information of the blown object, and displays the current state information on the indicating device 102 through the control system. In the present disclosure, by installing the indicating device on the dryer body of the intelligent hair dryer and indicating the operation state of the intelligent hair dryer and/or the current state of the blown object according to the control system, it can allow the user to accurately know the operation state of the intelligent hair dryer and/or the current state of the blown object.

An operating principle of the intelligent hair dryer provided by the present disclosure is mainly to implement the operation of the intelligent hair dryer by controlling, by the control system, collection modules for operation state of the hair dryer including a temperature sensor, a humidity sensor, a distance sensor, a temperature control module, and an air control module, etc. A brief description is made to each of these modules.

As a detection component for detecting humidity information of the blown object, the humidity sensor may be installed in the air inlet of the intelligent hair dryer, preferably installed at a position close to the air inlet in the airflow channel, and configured to collect air humidity near the blown object in real time. When using the intelligent hair dryer of the present disclosure to blow hair, the power of the intelligent hair dryer and the air-out speed and air volume of the air control module are dynamically adjusted according to the detected humidity information, so as to achieve hair care under constant temperature, save energy, and reduce consumption.

As a detection component for detecting the distance between the blown object and the intelligent hair dryer and detecting whether there exists the blown object within a blowing range, the distance sensor may be arranged on the dryer body of the intelligent hair dryer, and preferably arranged near the air outlet. Of course, the distance sensor may be arranged at the outer periphery of the intelligent hair dryer.

As a detection component for detecting a movement speed of the intelligent hair dryer, the acceleration sensor may be installed at any position inside the intelligent hair dryer. By detecting the movement speed, it may determine whether the hair dryer is moving quickly. The greater the acceleration is, the greater the air volume the hair dryer requires; and the higher the temperature is, the sooner the user wants to dry the hair, and thus it is required that the intelligent hair dryer is operated in a mode with a high blowing speed, a high temperature and a high negative ion concentration. The acceleration sensor controls the hair dryer to execute at least one of the following instructions: increasing the power of the heating wire, increasing the power of the motor, and increasing the concentration of the negative ions, etc. Optionally, the acceleration sensor is arranged in a handle of the intelligent hair dryer to recognize rapid swing of a gesture and provide a signal to the controller. After the controller recognizes the signal from the acceleration sensor, the mode with a high air blowing speed, a high temperature and a high negative ion concentration is started, the power of the heating wire is adjusted, the power of the motor fan is increased, and the concentration of the negative ions is increased.

The blowing temperature sensor is arranged between the heating wire (temperature control module) and the air outlet. Optionally, the temperature sensor may also be arranged near the blowing outlet inside the air outlet channel, and configured to detect the blowing temperature of the intelligent hair dryer in real time, and to dynamically adjust the power of the heating wire (temperature control module) and the blowing speed and blowing air volume of the motor (air control module) of the hair dryer according to the temperature change, such that a temperature difference of the blowing temperatures is within a deviation range to achieve hair care under constant temperature.

Meanwhile, the inside of the hair dryer of the present disclosure also includes components such as an ion generating device, a mica sheet, and a heating wire, etc.

The ion generating device is arranged at the air outlet of the intelligent hair dryer and configured to generate positive ions and/or negative ions. Optionally, the ion generating device is arranged between the heating wire and the air outlet. In an embodiment of the present disclosure, the ion generating device is a negative ion generating device. When blowing the hair, the ion generating device may neutralize static electricity on the surface of the hair, such that the hair is softer and smoother. Meanwhile, the ion generating device can improve the surrounding air, and achieve the effects of refreshment and sterilization and dust removal.

As an outer shell of the heating wire, the mica sheet can play the role of provide protection, insulation, thermal insulation, and support for the heating wire. The cylindrical mica sheet constitutes the air outlet channel of the heating wire. The mica sheet may be selected from a carbon fiber product, a far-infrared ceramic, a jade, and other materials. Meanwhile, an inside wall of the mica sheet is also coated with a far-infrared coating for generating far-infrared rays. The far-infrared coating emits the far-infrared rays to promote blood circulation in the scalp during hair blowing, improve immunity, and relieve headaches, dizziness, and insomnia and fatigue. Meanwhile, the mica sheet also can provide skin care and beauty, enhance metabolism, improve immunologic functions, and accelerate hair drying.

In addition, the mica sheet of the intelligent hair dryer of the present disclosure is arranged in a barrel shape with built-in brackets, and the spiral or corrugated heating wire is arranged between the brackets in the mica sheet to increase a touch area with the airflow. Meanwhile, the mica sheet also plays the role of providing insulation, heat insulation, and support for the heating wire.

The indicating device and the display device are important components in the intelligent hair dryer of the present disclosure, and in the above embodiments, the operating principles and structures of the indicating device and the display device in the intelligent hair dryer are respectively described.

Figure 5:
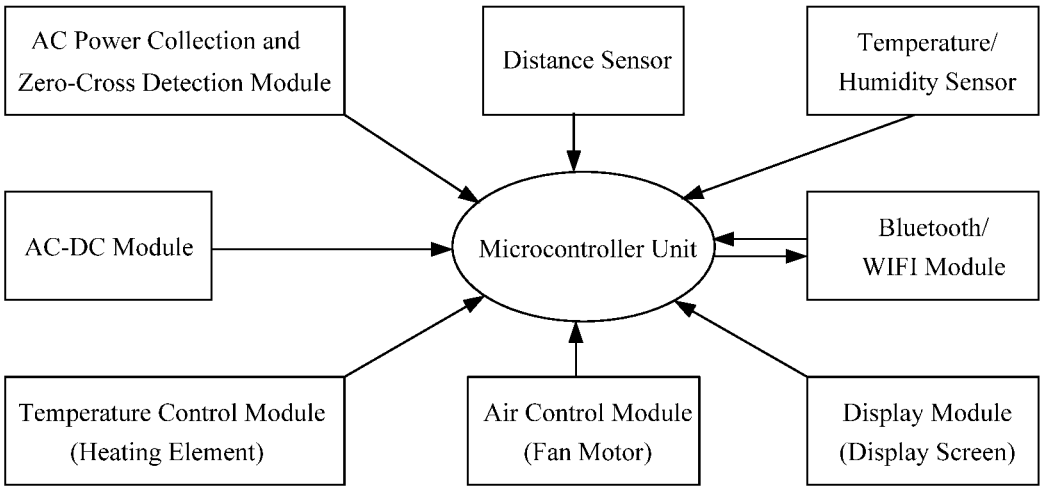
FIG. 5 is a schematic diagram showing a connection relationship between various components of the intelligent hair dryer according to an embodiment of the present disclosure.

In addition, FIG. 5 is a schematic diagram showing a connection relationship between various components of the intelligent hair dryer, which mainly include connection relationships between a microcontroller unit (MCU), a distance sensor, a temperature/humidity sensor, a WIFI module, a Bluetooth module, a display module, an air control module, a temperature control module, an AC-DC module, and an AC power collection and zero-cross detection module.

A second embodiment of the present disclosure provides another intelligent hair dryer, which includes: a dryer body, and a main air duct, an airflow detection channel, a sensor, a control system and a display driving device that are arranged inside the dryer body. In this embodiment, the main air duct is provided with an air outlet on the dryer body and is internally arranged with an airflow generating device (motor fan unit). An air inlet of the airflow detection channel and the air outlet of the main air duct are arranged on the same side of the dryer body. The sensor is arranged inside the airflow detection channel and is connected with a processor, and the sensor is configured to detect state information of the airflow. The display driving device is connected with the control system, and is configured to output the current state information of the blown object to a display terminal according to the detection result of the sensor, or to output the operation state information of the hair dryer to the display terminal according to the operation state information obtained by the control system.

The display device of the intelligent hair dryer may be installed on the dryer body of the intelligent hair dryer. As an implementation for installing the display device, the display device may be arranged on the other side with respect to the air outlet. The air outlet is arranged at the front end of the intelligent hair dryer, so the display device may be arranged at the rear end of the intelligent hair dryer. Optionally, the display device faces backwards the direction of the air outlet. In an embodiment of the present disclosure, the display device is perpendicular to an axis direction of the dryer body of the hair dryer, the axis of the dryer body of the hair dryer crosses over the display device, and the display device may have a circular ring structure or a square structure, which is not particularly limited herein. Such a position layout makes it convenient for the user to observe the display device and obtain the running state information of the hair dryer in time when the user uses the hair dryer. For example, when the user is drying hair of a pet, a blowing outlet is aimed at the pet, and the display screen at the rear end of the intelligent hair dryer faces towards the user, such that the user can obtain the running state information of the intelligent hair dryer in time. In this embodiment, the display device is a display screen, preferably a touch screen, and the display screen is connected with the display driving device. When blowing air to the blown object, the user can observe the operation state of the intelligent hair dryer or the current state information of the blown object in real time through the display device. Optionally, the display device is configured to display the humidity change on the surface of the blown object, an operating mode of the intelligent hair dryer, environmental parameters, and so on during the blowing process. For example, the display device is configured to display the operating mode (including an intelligent mode and a manual mode), or to display a fault identification when a fault occurs on the intelligent hair dryer. Furthermore, the display device is also configured to display the environmental parameters of the intelligent hair dryer (including temperature, humidity, distance, power, blowing speed, and motor rotation speed), the operation state information (including intelligent light ring, air duct stalling, motor overheating, sensor state information, battery power information, etc.), and the user state information (for example, different operation parameters required by different objects, different user information set for different objects, user information stored in the cloud or the processor, user state information obtained from the cloud or the processor and displayed by the intelligent hair dryer), and to display a user operation guide and related after-sales information, etc. In addition, the above user state information may be obtained from the cloud or the processor of the hair dryer. For example, information of different blown objects is prestored in the cloud, and may be obtained through face recognition, text input, and wireless communication.

In this embodiment, the intelligent hair dryer is also internally arranged with a wireless communication module, and the wireless communication module is connected with the display driving device and is configured to output the output information of the display driving device to an intelligent terminal or intelligent robot connected to an electrical signal. The intelligent terminal or intelligent robot performs information interaction with the intelligent hair dryer. As an optional embodiment, the intelligent terminal or intelligent robot displays the output information of the intelligent hair dryer, or the intelligent hair dryer executes instructions from the intelligent terminal or intelligent robot. The intelligent terminal may be at least one of data processing devices such as an intelligent phone, a PAD, a computer, etc. The intelligent robot may be at least one of any robots such as a sweeping robot, a vacuum cleaner, a washing machine, a window cleaning robot, a service robot, a housekeeping robot, a nanny robot, and a companion robot, etc. Of course, other materials that may be used as the display device of this embodiment also belong to the protection scope of the present disclosure.

In addition, the indicating device described in the foregoing embodiment may also be arranged on an outer side of the dryer body of the intelligent hair dryer. The indicating device is connected with the processor and is configured to indicate the current state of the blown object or the operation state of the hair dryer according to the detection result of the sensor. Reference may be made to the related description of the first embodiment for the specific operation principle of the indicating device, and thus repeated description is omitted herein.

In addition, the display device of the intelligent hair dryer of the present disclosure has a touch function, which is used for controlling the switching of the operating modes of the intelligent hair dryer, and for inputting and/or outputting the blowing parameters of the intelligent hair dryer. In terms of control modes, the user may input and/or output the blowing parameters of the intelligent hair dryer by manual input, clicking, checking, long press, sliding, gesture control, and voice control, etc. The display device may display the operation state information of the intelligent hair dryer in a text, pattern or language manner.

In an embodiment of the present disclosure, the indicating device and the display device of the intelligent hair dryer are any one of LED lights, LCD screens, and OLED display screens. As an optional embodiment, the indicating device and the display device are any one of LED strips, curved screens, and flexible display screens.

In the above two embodiments, two types of intelligent hair dryers are respectively provided. Correspondingly, a third embodiment of the present disclosure provides a method for automatically controlling the operation of the intelligent hair dryer.

Figure 6:
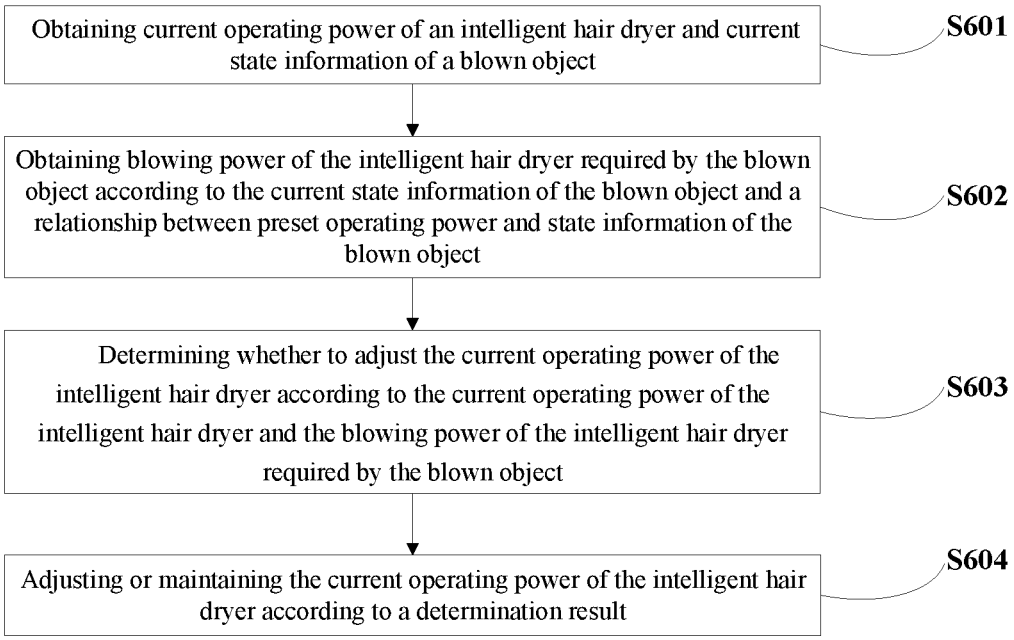
FIG. 6 is a method flowchart of a job control method according to a third embodiment of the present disclosure.

As shown in FIG. 6, a flowchart of a job control method according to the third embodiment of the present disclosure is illustrated. The method embodiment is basically similar to the apparatus embodiment, thus description of the method embodiment is relatively simple, and reference may be made to the description of the apparatus embodiment for relevant parts. The following description of the method embodiment is merely exemplary.

FIG. 6 is a schematic flowchart of a job control method according to the third embodiment of the present disclosure. As shown in FIG. 6, the method includes steps S601 to S604.

Step S601: obtaining current operating power of an intelligent hair dryer and current state information of a blown object.

When the method of the present disclosure is used to automatically control the intelligent hair dryer to perform blowing operation, first, the intelligent hair dryer runs according to initial default power. For example, the hair dryer may be run according to the initial power $P_0$, which is slightly larger than the minimum power $P_{min}$ at which the intelligent hair dryer can be run and standby.

After running the intelligent hair dryer, it is determined whether there exists a blown object within a specified distance from the air outlet of the intelligent hair dryer. The power of the intelligent hair dryer is adjusted to the minimum power $P_{min}$ if there does not exist the blown object, and the current state information of the blown object is obtained if there exists the blown object.

Step S602: obtaining blowing power of the intelligent hair dryer required by the blown object according to the current state information of the blown object and a relationship between preset operating power and state information of the blown object.

After the current state information of the blown object is obtained, the power required by the blown object is obtained according to the current state information of the blown object and the relationship between the preset operating power and the state information of the blown object. Since the state information of the blown object may change after using the method of the present disclosure to blow air for a period of time, it is necessary to obtain the state information of the blown object in real time, and obtain the blowing power of the intelligent hair dryer required by the blown object according to the obtained state information of the blown object.

As a method to obtain the state information of the blown object, first, airflow having touched the blown object is obtained, then state information of the airflow having touched the blown object is obtained, and finally, state calculation information of the blown object is calculated according to the state information of the airflow, and the state calculation information is used as the current state information of the blown object. The state information of the airflow includes at least one of temperature information and humidity information of the airflow, and the state calculation information of the blown object includes at least one of temperature calculation information and humidity calculation information of the blown object.

After the state information of the blown object is obtained, the blowing power of the intelligent hair dryer required by the blown object is obtained according to the current state information of the blown object and the relationship between the preset operating power and the state information of the blown object.

Step S603: determining whether to adjust the current operating power according to the current operating power of the intelligent hair dryer and the blowing power of the intelligent hair dryer required by the blown object.

After the blowing power of the intelligent hair dryer required by the blown object is obtained, it is determined whether to adjust the current operating power according to the current operating power of the intelligent hair dryer and the blowing power of the intelligent hair dryer required by the blown object.

Step S604: adjusting or maintaining the current operating power of the intelligent hair dryer according to a determination result.

After it is determined whether to adjust the current operating power, the current operating power of the intelligent hair dryer is adjusted or maintained according to the determination result.

For example, after blowing air for a period of time, the blown object changes from original wet hair to semi-wet hair. At this moment, the current operating power of the intelligent hair dryer is denoted as $P_{max}$, and the blowing power of the intelligent hair dryer required by the blown object is denoted as $P_1$ ($P_1$ is less than $P_{max}$). Therefore, the power of the hair dryer needs to be adjusted from $P_{max}$ to $P_1$. If the blown object is still wet hair, the current operating power $P_{max}$ of the intelligent hair dryer is kept unchanged.

In the above method for automatically controlling operation of the intelligent hair dryer, by using humidity information and/or temperature information obtained by the sensors arranged in the airflow detection channel in the intelligent hair dryer, intelligent control of the operation of the hair dryer is realized, and the use experience of the hair dryer is effectively improved Application Scenario 1

When the user uses the intelligent hair dryer to blow wet hair, the intelligent hair dryer is turned on to enter the intelligent mode. If the distance sensor detects that there exists a blown object (i.e., the hair), the intelligent hair dryer is run at the initial power $P_0$. When the humidity sensor detects that the hair is wet and determines that there is a need to blow wet hair, the power of the intelligent hair dryer is adjusted to $P_{max}$. After running the intelligent hair dryer for a period of time, the wet hair becomes semi-dry hair, and the color of the intelligent light ring gradually changes from a gradient color to blue, and the power of the intelligent hair dryer is automatically decreased to $P_1$. In this process, the intelligent hair dryer can automatically adjust its power, which can avoid the trouble of manually adjusting the power of the intelligent hair dryer.

Application Scenario 2

After the user finishes using the intelligent hair dryer, the distance sensor of the intelligent hair dryer automatically recognizes that there is no blown object within the specified distance, then the power of the intelligent hair dryer is decreased to power $P_{min}$ and the intelligent hair dryer is run at the power $P_{min}$. After running for a period of time, the intelligent hair dryer automatically enters a standby state if the distance sensor still automatically recognizes that there is no blown object within the specified distance. The intelligent hair dryer ensures safety during use.

Correspondingly, an embodiment of the present disclosure also provides a computer-readable storage medium with computer instructions stored therein. When the computer instructions are executed by one or more processors, the one or more processors are caused to execute the steps in the above job control method.

Figure 7:
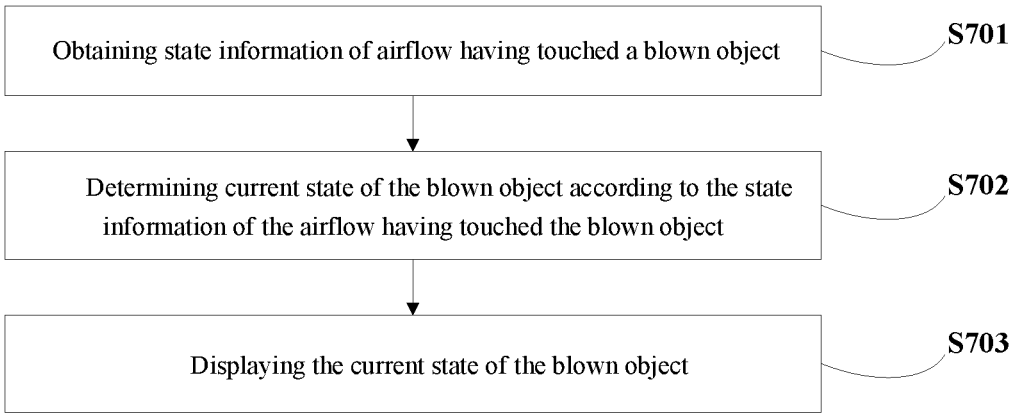
FIG. 7 is a schematic flowchart of an information display method according to an embodiment of the present disclosure.

FIG. 7 is a schematic flowchart of an information display method according to embodiments of the present disclosure. As shown in FIG. 7, this method includes following steps.

Step S701: obtaining state information of airflow having touched a blown object.

Step S702: determining current state of the blown object according to the state information of the airflow.

Step S703: displaying the current state of the blown object.

In this embodiment, the hair dryer includes: a dryer body, a main air duct, a control system and an airflow detection channel arranged inside the dryer body, and a sensor arranged inside the airflow detection channel. The hair dryer also includes an indicating device arranged on the dryer body. Reference may be made to relevant contents of the above-mentioned embodiments for the implementation form of the indicating device, and thus repeated description is omitted herein. In this embodiment, the air inlet of the airflow detection channel and the air outlet of the main air duct are arranged on the same side of the dryer body. When the hair dryer blows air to the blown object, both the air inlet of the airflow detection channel and the air outlet of the main air duct are opposite to the blown object.

In this embodiment, the sensor is arranged inside the airflow detection channel, and the sensor can detect state information of airflow entering the airflow detection channel. When the hair dryer blows the air to the blown object, the airflow having touched the blown object may enter the airflow detection channel through the air inlet of the airflow detection channel, and may flow inside the airflow detection channel to touch the sensor. In this way, the sensor may collect the state information of the airflow having touched the blown object. Since the airflow having touched the blown object carries the state information of the blown object, the state information of the airflow having touched the blown object may reflect the state information of the blown object. Reference may be made to the related contents of the above embodiments for the description of the state information of the airflow, and thus repeated description is omitted herein. Further, the sensor may provide, to the control system, the state information of the airflow having touched the blown object.

Further, the control system is connected with the indicating device and is configured to control the indicating device to indicate current state of the blown object according to a detection result of the sensor. That is, the control system can control the indicating device to indicate the current state of the blown object according to the state information of the airflow. In this way, the user may intuitively know the current state of the blown object, thereby helping to improve the user experience.

It is worth noting that reference may be made to the relevant contents of the above embodiments for specific implementations of Step S701 to Step S703, and details are not repeated here.

Correspondingly, an embodiment of the present disclosure also provides a computer-readable storage medium with computer instructions stored therein. When the computer instructions are executed by one or more processors, the one or more processors are caused to execute the steps in the above information display method.

It is to be noted that, subjects execute each step of the method provided in the above embodiment may be the same device, or the method may also be executed by different devices. For example, a subject executing Steps S201 and S202 may be a device A. For another example, a subject executing the Step S201 may be the device A, and a subject executing Step S202 may be a device B, and so on.

In addition, some processes described in the above embodiments and drawings include a plurality of operations appearing in a specific order. However, it should be clearly understood that these operations may be executed out of the order in which these operations appear herein or may be executed concurrently. Sequence numbers of these operations such as S201, S202, etc., are merely intended to distinguish different operations, and the sequence numbers themselves do not represent any execution order. In addition, these processes may include more or fewer operations, and these operations may be executed sequentially or concurrently.

It is also worth noting that in each embodiment of the present disclosure, the control system may include a controller and a peripheral circuit thereof. The controller may be any hardware processing device. Optionally, the processor may be a central processing unit (CPU), a graphics processing unit (GPU), or a microcontroller unit (MCU). The processor may also be a field-programmable gate array (FPGA), a programmable array logic (PAL) device, a general array logic (GAL) device, a complex programmable logic device (CPLD) and other programmable devices. Alternatively, the processor may also be an advanced RISC machines (ARM) processor or a system on chip (SOC). However, the processor is not limited thereto.

Although the present disclosure is disclosed as above with preferred embodiments, the present disclosure is not limited thereto. Any person skilled in the art can make possible variations and modifications without departing from the spirit and scope of the present disclosure. Therefore, the protection scope of the present disclosure shall be subject to the scope defined by the claims of the present disclosure.

Those skilled in the art should understand that the embodiments of the present disclosure may be provided as a method, a system or a computer program product. Therefore, the present disclosure may adopt forms of a full hardware embodiment, a full software embodiment, or an embodiment in combination of software and hardware aspects.

Furthermore, the present disclosure may adopt forms of computer program products implemented on one or more computer storage media (including but not limited to a magnetic disk memory, a CD-ROM, an optical memory or the like) which includes computer program codes.

The present disclosure is described with reference to flowcharts and/or block diagrams of the methods, devices (systems) and computer program products in the embodiments of the present disclosure. It should be understood that each flow and/or block in the flowcharts and/or block diagrams and a combination thereof may be implemented by means of computer program instructions. These computer program instructions may be provided to a general-purpose computer, a special-purpose computer, an embedded processor or processors of other programmable data processing devices to generate a machine, so as to generate an apparatus configured to implement specified functions in one or more flows of a flowchart and/or one or more blocks of a block diagram by means of instructions executed by a computer or a processor of the other programmable data processing device.

These computer program instructions may also be stored in a computer-readable memory that can guide a computer or other programmable data processing devices to operate in a particular way, so that the instructions stored in the computer-readable memory generate a manufactured product including an instruction apparatus that implements the specific functions in one or more flows of a flowchart and/or one or more blocks of a block diagram.

These computer program instructions may also be loaded on a computer or other programmable data processing devices, so that a series of operating steps can be executed on the computer or other programmable devices to produce computer-implemented processing, and thus instructions executed on the computer or other programmable devices provide steps for implementing specific functions in one or more flows of a flowchart and/or one or more blocks of a block diagram.

In a typical configuration, a computing device includes one or more CPUs, input/output interfaces, network interfaces, and a memory.

The memory may include a volatile memory, a random access memory (RAM) and/or a non-volatile memory in a computer-readable medium, such as a read-only memory (ROM) or a flash RAM. The memory is an example of the computer-readable medium.

The computer-readable medium includes a non-volatile medium, a volatile medium, a mobile medium or an immobile medium, which may implement information storage by means of any method or technology. Information may be computer-readable instructions, data structures, modules of a program, or other data. Examples of computer storage media include, but are not limited to, a phase change random access memory (PRAM), a static random access memory (SRAM), a dynamic random access memory (DRAM), other types of random access memory (RAM), a read-only memory (ROM), an electrically erasable programmable read-only memory (EEPROM), a flash memory or other memory technologies, a compact disc read-only memory (CD-ROM), a digital versatile disc (DVD) or other optical storage, a cartridge magnetic tape, a magnetic tape or magnetic disk storage or other magnetic storage devices or any other non-transmission media, which may be configured to store information that may be accessed by the computing device. As defined herein, the computer-readable media do not include transitory media, for example, modulated data signals and carriers.

It should also be noted that, terms such as "comprise", "include" or any other variants thereof are intended to cover a non-exclusive inclusion, so that a process, a method, a product, or a device including a series of elements includes not only these elements, but also other elements that are not explicitly listed, or also includes inherent elements of the process, the method, the product or the device. In the case of no more restrictions, the element defined by a sentence "includes/including a . . . " does not exclude the existence of additional identical elements in the process, the method, the product or the device including the element.

The above description is only illustrated as embodiments of the present disclosure, and are not intended to limit the present disclosure. To those skilled in the art, various modifications and variations may be made to the present disclosure. Any modification, equivalent replacement, and improvement, etc. made within the spirit and principle of the present disclosure shall fall within the protection scope of the claims of the present disclosure.

What is claimed is:

1. A job control method, comprising:

obtaining state information of airflow having touched a blown object, and controlling an indicating device to display the current state information of the blown object; wherein, the state information of the airflow comprises both temperature information and humidity information of the airflow; a shape of the indicating device is set to any one of a continuous or discontinuous ring-shaped structure surrounding a dryer body of the intelligent hair dryer, and a strip-shaped structure arranged along an outer side of the dryer body;

calculating state calculation information of the blown object according to the state information of the airflow;

obtaining blowing parameters of an intelligent hair dryer required by the blown object according to the state calculation information of the blown object; and controlling the intelligent hair dryer to blow air to the blown object according to the blowing parameters of the intelligent hair dryer required by the blown object.

2. The method according to claim 1, wherein the state calculation information of the blown object comprises both temperature calculation information and humidity calculation information of the blown object.

3. The method according to claim 1, further comprising: obtaining current blowing parameters of the intelligent hair dryer in real time, wherein the blowing parameters of the intelligent hair dryer comprise a blowing speed and a blowing temperature; and determining whether to adjust the blowing parameters of the intelligent hair dryer according to the current blowing parameters of the intelligent hair dryer and the blowing parameters of the intelligent hair dryer required by the blown object, wherein the current blowing parameters of the intelligent hair dryer are enhanced when the current blowing parameters of the intelligent hair dryer are less than the blowing parameters of the intelligent hair dryer required by the blown object, and otherwise, the current blowing parameters of the intelligent hair dryer are weakened.

* * * * *